US009600960B2

(12) United States Patent
Arnone et al.

(10) Patent No.: US 9,600,960 B2
(45) **Date of Patent: *Mar. 21, 2017**

(54) SUDOKU STYLE HYBRID GAME

(71) Applicant: Gamblit Gaming, LLC, Glendale, CA (US)

(72) Inventors: Miles Arnone, Sherborn, MA (US); Frank Cire, Pasadena, CA (US); Caitlyn Ross, Watertown, MA (US); Scott Shimmin, Vista, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/053,236

(22) Filed: Feb. 25, 2016

(65) Prior Publication Data

US 2016/0171823 A1 Jun. 16, 2016

Related U.S. Application Data

(63) Continuation of application No. 14/555,401, filed on Nov. 26, 2014, now Pat. No. 9,302,175, which is a continuation of application No. PCT/US2013/043182, filed on May 29, 2013.

(60) Provisional application No. 61/652,739, filed on May 29, 2012.

(51) Int. Cl.
*G07F 17/32* (2006.01)
*A63F 3/04* (2006.01)

(52) U.S. Cl.
CPC ..... *G07F 17/3223* (2013.01); *A63F 3/0421* (2013.01); *G07F 17/3227* (2013.01); *G07F 17/3237* (2013.01); *G07F 17/3267* (2013.01); *G07F 17/3269* (2013.01); *G07F 17/3288* (2013.01); *G07F 17/3295* (2013.01); *A63F 2003/0418* (2013.01)

(58) Field of Classification Search
CPC ..... G07F 17/32
See application file for complete search history.

(56) References Cited

U.S. PATENT DOCUMENTS

| | | | |
|---|---|---|---|
| 5,413,357 | A | 5/1995 | Schulze et al. |
| 5,718,429 | A | 2/1998 | Keller |
| 5,785,592 | A | 7/1998 | Jacobsen |
| 5,853,324 | A | 12/1998 | Kami et al. |
| 5,963,745 | A | 10/1999 | Collins et al. |
| 6,050,895 | A | 4/2000 | Luciano |
| 6,165,071 | A | 12/2000 | Weiss |
| 6,227,974 | B1 | 5/2001 | Eilat et al. |
| 6,267,669 | B1 | 7/2001 | Luciano |
| 6,685,563 | B1 | 2/2004 | Meekins et al. |

(Continued)

OTHER PUBLICATIONS

U.S. Appl. No. 14/205,303 Arnone, et al., filed Mar. 11, 2014.

(Continued)

*Primary Examiner* — Omkar Deodhar
(74) *Attorney, Agent, or Firm* — Caitlyn Ross

(57) ABSTRACT

Systems and methods for operating a Sudoku style hybrid game on a mobile device are disclosed. Sudoku style hybrid games can include a themed entertainment game in which a player places symbols into a Sudoku puzzle and events within the entertainment portion of the Sudoku style entertainment game can trigger wagers in a real world game of chance. The outcome of the wagers can result in payouts of real world credit and can also affect gameplay within the Sudoku style entertainment game.

9 Claims, 11 Drawing Sheets

(56) References Cited

U.S. PATENT DOCUMENTS 6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.

(56) References Cited

U.S. PATENT DOCUMENTS

| | | | |
|---|---|---|---|
| 2009/0176566 | A1 | 7/2009 | Kelly |
| 2009/0181777 | A1 | 7/2009 | Christiani |
| 2009/0221355 | A1 | 9/2009 | Dunaevsky et al. |
| 2009/0239610 | A1 | 9/2009 | Olive |
| 2009/0247272 | A1 | 10/2009 | Abe |
| 2009/0270164 | A1 | 10/2009 | Seelig |
| 2009/0291755 | A1 | 11/2009 | Walker et al. |
| 2009/0309305 | A1 | 12/2009 | May |
| 2009/0312093 | A1 | 12/2009 | Walker et al. |
| 2009/0325686 | A1 | 12/2009 | Davis |
| 2010/0004058 | A1 | 1/2010 | Acres |
| 2010/0016056 | A1 | 1/2010 | Thomas et al. |
| 2010/0029373 | A1 | 2/2010 | Graham et al. |
| 2010/0035674 | A1 | 2/2010 | Slomiany |
| 2010/0056247 | A1 | 3/2010 | Nicely |
| 2010/0056260 | A1 | 3/2010 | Fujimoto |
| 2010/0062836 | A1 | 3/2010 | Young |
| 2010/0093420 | A1 | 4/2010 | Wright |
| 2010/0093444 | A1 | 4/2010 | Biggar et al. |
| 2010/0105454 | A1 | 4/2010 | Weber |
| 2010/0120525 | A1 | 5/2010 | Baerlocher et al. |
| 2010/0124983 | A1 | 5/2010 | Gowin et al. |
| 2010/0137047 | A1 | 6/2010 | Englman et al. |
| 2010/0174593 | A1 | 7/2010 | Cao |
| 2010/0184509 | A1 | 7/2010 | Sylla et al. |
| 2010/0203940 | A1 | 8/2010 | Alderucci et al. |
| 2010/0210344 | A1 | 8/2010 | Edidin et al. |
| 2010/0227672 | A1 | 9/2010 | Amour |
| 2010/0227688 | A1 | 9/2010 | Lee |
| 2010/0240436 | A1 | 9/2010 | Wilson et al. |
| 2010/0304825 | A1 | 12/2010 | Davis |
| 2010/0304839 | A1 | 12/2010 | Johnson |
| 2010/0304842 | A1 | 12/2010 | Friedman et al. |
| 2011/0009177 | A1 | 1/2011 | Katz |
| 2011/0009178 | A1 | 1/2011 | Gerson |
| 2011/0045896 | A1 | 2/2011 | Sak et al. |
| 2011/0077087 | A1 | 3/2011 | Walker et al. |
| 2011/0082571 | A1 | 4/2011 | Murdock et al. |
| 2011/0105206 | A1 | 5/2011 | Rowe et al. |
| 2011/0107239 | A1 | 5/2011 | Adoni |
| 2011/0109454 | A1 | 5/2011 | McSheffrey |
| 2011/0111820 | A1 | 5/2011 | Filipour |
| 2011/0111837 | A1 | 5/2011 | Gagner |
| 2011/0111841 | A1 | 5/2011 | Tessmer |
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0230267 | A1 | 9/2011 | Van Luchene |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2011/0319169 | A1 | 12/2011 | Lam |
| 2012/0004747 | A1 | 1/2012 | Kelly |
| 2012/0028718 | A1 | 2/2012 | Barclay et al. |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0135793 | A1 | 5/2012 | Antonopoulos |
| 2012/0202587 | A1 | 8/2012 | Allen |
| 2012/0302311 | A1 | 11/2012 | Luciano |
| 2012/0322545 | A1 | 12/2012 | Arnone et al. |
| 2013/0029760 | A1 | 1/2013 | Wickett |
| 2013/0131848 | A1 | 5/2013 | Arnone et al. |
| 2013/0190074 | A1 | 7/2013 | Arnone et al. |
| 2013/0260869 | A1 | 10/2013 | Basallo et al. |
| 2014/0087801 | A1 | 3/2014 | Nicely et al. |
| 2014/0087808 | A1 | 3/2014 | Basallo et al. |
| 2014/0087809 | A1 | 3/2014 | Leupp et al. |
| 2014/0357350 | A1 | 12/2014 | Weingardt et al. |

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al., filed Apr. 17, 2014.
U.S. Appl. No. 14/263,988 Arnone, et al., filed Apr. 28, 2014.
U.S. Appl. No. 14/270,335 Arnone, et al., filed May 5, 2014.
U.S. Appl. No. 14/271,360 Arnone, et al., filed May 6, 2014.
U.S. Appl. No. 13/961,849 Arnone, et al., filed Aug. 7, 2013.
U.S. Appl. No. 13/746,850 Arnone, et al., filed Jan. 22, 2013.
U.S. Appl. No. 14/288,169 Arnone, et al., filed May 27, 2014.
U.S. Appl. No. 14/304,027 Arnone, et al., filed Jun. 13, 2014.
U.S. Appl. No. 14/306,187 Arnone, et al., filed Jun. 16, 2014.
U.S. Appl. No. 14/312,623 Arnone, et al., filed Jun. 24, 2014.
U.S. Appl. No. 14/330,249 Arnone, et al., filed Jul. 14, 2014.
U.S. Appl. No. 14/339,142 Arnone, et al., filed Jul. 23, 2014.
U.S. Appl. No. 14/458,206 Arnone, et al., filed Aug. 12, 2014.
U.S. Appl. No. 14/461,344 Arnone, et al., filed Aug. 15, 2014.
U.S. Appl. No. 14/462,516 Arnone, et al., filed Aug. 18, 2014.
U.S. Appl. No. 14/467,646 Meyerhofer, et al., filed Aug. 25, 2014.
U.S. Appl. No. 14/474,023 Arnone, et al., filed Aug. 29, 2014.
U.S. Appl. No. 14/486,895 Arnone, et al., filed Sep. 15, 2014.
U.S. Appl. No. 14/507,206 Arnone, et al., filed Oct. 6, 2014.
U.S. Appl. No. 14/521,338 Arnone, et al., filed Oct. 22, 2014.
U.S. Appl. No. 14/535,808 Arnone, et al., filed Nov. 7, 2014.
U.S. Appl. No. 14/535,816 Arnone, et al., filed Nov. 7, 2014.
U.S. Appl. No. 14/536,231 Arnone, et al., filed Nov. 7, 2014.
U.S. Appl. No. 14/536,280 Arnone, et al., filed Nov. 7, 2014.
U.S. Appl. No. 14/549,137 Arnone, et al., filed Nov. 20, 2014.
U.S. Appl. No. 14/550,802 Arnone, et al., filed Nov. 21, 2014.
U.S. Appl. No. 14/555,401 Arnone, et al., filed Nov. 26, 2014.
U.S. Appl. No. 14/559,840 Arnone, et al., filed Dec. 3, 2014.
U.S. Appl. No. 14/564,834 Arnone, et al., filed Dec. 9, 2014.
U.S. Appl. No. 14/570,746 Arnone, et al., filed Dec. 15, 2014.
U.S. Appl. No. 14/570,857 Arnone, et al., filed Dec. 15, 2014.
U.S. Appl. No. 14/586,626 Arnone, et al., filed Dec. 30, 2014.
U.S. Appl. No. 14/586,639 Arnone, et al., filed Dec. 30, 2014.
U.S. Appl. No. 14/815,764 Arnone, et al., filed Jul. 31, 2015.
U.S. Appl. No. 14/815,774 Arnone, et al., filed Jul. 31, 2015.
U.S. Appl. No. 14/817,032 Arnone, et al., filed Aug. 3, 2015.
U.S. Appl. No. 14/822,890 Arnone, et al., filed Aug. 10, 2015.
U.S. Appl. No. 14/823,951 Arnone, et al., filed Aug. 11, 2015.
U.S. Appl. No. 14/823,987 Arnone, et al., filed Aug. 11, 2015.
U.S. Appl. No. 14/825,056 Arnone, et al., filed Aug. 12, 2015.
U.S. Appl. No. 14/835,590 Arnone, et al., filed Aug. 25, 2015.
U.S. Appl. No. 14/836,902 Arnone, et al., filed Aug. 26, 2015.
U.S. Appl. No. 14/839,647 Arnone, et al., filed Aug. 28, 2015.
U.S. Appl. No. 14/842,684 Arnone, et al., filed Sep. 1, 2015.
U.S. Appl. No. 14/842,785 Arnone, et al., filed Sep. 1, 2015.
U.S. Appl. No. 14/854,021 Arnone, et al., filed Sep. 14, 2015.
U.S. Appl. No. 14/855,322 Arnone, et al., filed Sep. 15, 2015.
U.S. Appl. No. 14/859,065 Arnone, et al., filed Sep. 18, 2015.
U.S. Appl. No. 14/865,422 Arnone, et al., filed Sep. 25, 2015.
U.S. Appl. No. 14/867,809 Arnone, et al., filed Sep. 28, 2015.
U.S. Appl. No. 14/868,287 Arnone, et al., filed Sep. 28, 2015.
U.S. Appl. No. 14/868,364 Arnone, et al., filed Sep. 28, 2015.
U.S. Appl. No. 14/869,809 Arnone, et al., filed Sep. 29, 2015.
U.S. Appl. No. 14/869,819 Arnone, et al., filed Sep. 29, 2015.
U.S. Appl. No. 14/885,894 Arnone, et al., filed Oct. 16, 2015.
U.S. Appl. No. 14/919,665 Arnone, et al., filed Oct. 21, 2015.
U.S. Appl. No. 14/942,844 Arnone, et al., filed Nov. 16, 2015.
U.S. Appl. No. 14/942,883 Arnone, et al., filed Nov. 16, 2015.
U.S. Appl. No. 14/949,759 Arnone, et al., filed Nov. 23, 2015.
U.S. Appl. No. 14/952,758 Arnone, et al., filed Nov. 25, 2015.

(56) References Cited

OTHER PUBLICATIONS

U.S. Appl. No. 14/952,769 Arnone, et al., filed Nov. 25, 2015.
U.S. Appl. No. 14/954,922 Arnone, et al., filed Nov. 30, 2015.
U.S. Appl. No. 14/954,931 Arnone, et al., filed Nov. 30, 2015.
U.S. Appl. No. 14/955,000 Arnone, et al., filed Nov. 30, 2015.
U.S. Appl. No. 14/956,301 Arnone, et al., filed Dec. 1, 2015.
U.S. Appl. No. 14/965,231 Arnone, et al., filed Dec. 10, 2015.
U.S. Appl. No. 14/965,846 Arnone, et al., filed Dec. 10, 2015.
U.S. Appl. No. 14/981,640 Arnone, et al., filed Dec. 28, 2015.
U.S. Appl. No. 14/981,775 Arnone, et al., filed Dec. 28, 2015.
U.S. Appl. No. 14/984,943 Arnone, et al., filed Dec. 30, 2015.
U.S. Appl. No. 14/984,965 Arnone, et al., filed Dec. 30, 2015.
U.S. Appl. No. 14/984,978 Arnone, et al., filed Dec. 30, 2015.
U.S. Appl. No. 14/985,107 Arnone, et al., filed Dec. 30, 2015.
U.S. Appl. No. 14/995,151 Arnone, et al., filed Jan. 13, 2016.
U.S. Appl. No. 14/904,947 Arnone, et al., filed Jan. 13, 2016.
U.S. Appl. No. 14/997,413 Arnone, et al., filed Jan. 15, 2016.
U.S. Appl. No. 15/002,233 Arnone, et al., filed Jan. 20, 2016.
U.S. Appl. No. 15/005,944 Arnone, et al., filed Jan. 25, 2016.
U.S. Appl. No. 15/011,322 Arnone, et al., filed Jan. 29, 2016.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 141162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/586,645 Arnone, et al., filed Dec. 30, 2014.
U.S. Appl. No. 14/598,151 Arnone, et al., filed Jan. 15, 2015.
U.S. Appl. No. 14/601,063 Arnone, et al., filed Jan. 20, 2015.
U.S. Appl. No. 14/601,108 Arnone, et al., filed Jan. 20, 2015.
U.S. Appl. No. 14/608,000 Arnone, et al., filed Jan. 28, 2015.
U.S. Appl. No. 14/608,087 Arnone, et al., filed Jan. 28, 2015.
U.S. Appl. No. 14/608,093 Arnone, et al., filed Jan. 28, 2015.
U.S. Appl. No. 14/610,897 Arnone, et al., filed Jan. 30, 2015.
U.S. Appl. No. 14/611,077 Arnone, et al., filed Jan. 30, 2015.
U.S. Appl. No. 14/604,629 Arnone, et al., filed Jan. 23, 2015.
U.S. Appl. No. 14/625,475 Arnone, et al., filed Feb. 18, 2015.
U.S. Appl. No. 14/617,852 Arnone, et al., filed Feb. 9, 2015.
U.S. Appl. No. 14/627,428 Arnone, et al., filed Feb. 20, 2015.
U.S. Appl. No. 14/642,427 Arnone, et al., filed Mar. 9, 2015.
U.S. Appl. No. 14/665,991 Arnone, et al., filed Mar. 23, 2015.
U.S. Appl. No. 14/666,010 Arnone, et al., filed Mar. 23, 2015.
U.S. Appl. No. 14/666,022 Arnone, et al., filed Mar. 23, 2015.
U.S. Appl. No. 14/642,623 Arnone, et al., filed Mar. 9, 2015.
U.S. Appl. No. 14/663,337 Arnone, et al., filed Mar. 19, 2015.
U.S. Appl. No. 14/666,284 Arnone, et al., filed Mar. 23, 2015.
U.S. Appl. No. 14/679,885 Arnone, et al., filed Apr. 6, 2015.
U.S. Appl. No. 14/685,378 Arnone, et al., filed Apr. 13, 2015.
U.S. Appl. No. 14/686,675 Arnone, et al., filed Apr. 14, 2015.
U.S. Appl. No. 14/686,678 Arnone, et al., filed Apr. 14, 2015.
U.S. Appl. No. 14/701,430 Arnone, et al., filed Apr. 30, 2015.
U.S. Appl. No. 14/703,721 Arnone, et al., filed May 4, 2015.
U.S. Appl. No. 14/708,138 Arnone, et al., filed May 8, 2015.
U.S. Appl. No. 14/708,141 Arnone, et al., filed May 8, 2015.
U.S. Appl. No. 14/708,160 Arnone, et al., filed May 8, 2015.
U.S. Appl. No. 14/708,161 Arnone, et al., filed May 8, 2015.
U.S. Appl. No. 14/708,162 Arnone, et al., filed May 8, 2015.
U.S. Appl. No. 14/710,483 Arnone, et al., filed May 12, 2015.
U.S. Appl. No. 14/714,084 Arnone, et al., filed May 15, 2015.
U.S. Appl. No. 14/715,463 Arnone, et al., filed May 18, 2015.
U.S. Appl. No. 14/720,620 Arnone, et al., filed May 22, 2015.
U.S. Appl. No. 14/720,624 Arnone, et al., filed May 22, 2015.
U.S. Appl. No. 14/720,626 Arnone, et al., filed May 22, 2015.
U.S. Appl. No. 14/727,726 Arnone, et al., filed Jun. 1, 2015.
U.S. Appl. No. 14/730,183 Arnone, et al., filed Jun. 3, 2015.
U.S. Appl. No. 14/731,321 Arnone, et al., filed Jun. 4, 2015.
U.S. Appl. No. 14/740,078 Arnone, et al., filed Jun. 15, 2015.
U.S. Appl. No. 14/742,517 Arnone, et al., filed Jun. 17, 2015.
U.S. Appl. No. 14/743,708 Arnone, et al., filed Jun. 18, 2015.
U.S. Appl. No. 14/746,731 Arnone, et al., filed Jun. 22, 2015.
U.S. Appl. No. 14/748,122 Arnone, et al., filed Jun. 23, 2015.
U.S. Appl. No. 14/788,581 Arnone, et al., filed Jun. 30, 2015.
U.S. Appl. No. 14/793,685 Arnone, et al., filed Jul. 7, 2015.
U.S. Appl. No. 14/793,704 Arnone, et al., filed Jul. 7, 2015.
U.S. Appl. No. 14/797,016 Arnone, et al., filed Jul. 10, 2015.
U.S. Appl. No. 14/799,481 Arnone, et al., filed Jul. 14, 2015.
International Search Report and Written Opinion, PCT/US2013/43182, Oct. 24, 2013.

SUDOKU STYLE HYBRID GAME

CROSS REFERENCE TO RELATED APPLICATIONS

This application is a continuation of U.S. patent application Ser. No. 14/555,401, filed Nov. 26, 2014, which is a continuation of Patent Cooperation Treaty Application No. PCT/US13/43182, filed May 29, 2013, which claims the benefit of U.S. Provisional Patent Application No. 61/652,739, filed on May 29, 2012, the contents of each of which are hereby incorporated by reference.

This application references Patent Cooperation Treaty Application No. PCT/US11/26768, filed Mar. 1, 2011, Patent Cooperation Treaty Application No. PCT/US11/63587, filed Dec. 6, 2011, and Patent Cooperation Treaty Application No. PCT/US12/58156, the contents of each of which are hereby incorporated by reference.

FIELD OF THE INVENTION

Embodiments of the present invention are generally related to gaming and more specifically to Sudoku style hybrid games that include both a Sudoku style entertainment game and a gambling game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game can depend upon a player's skill with the game. Gambling games are typically not as interactive and do not include graphics as sophisticated as an entertainment game, which is a game of skill such as a video game.

SUMMARY OF THE INVENTION

System in accordance with embodiments of the invention operate a Sudoku style hybrid game on a mobile device.

In one embodiment, the Sudoku style hybrid game includes a real world engine connected by a communication link to a game world engine and constructed to provide a randomly generated payout of real world credits from a wager in a gambling game using a real world credit meter, a random number generator, and a real world credit pay table, an entertainment software engine of a mobile device connected to the game world engine by a network and constructed to execute a Sudoku style entertainment game providing outcomes based upon a player's skillful execution of the Sudoku style entertainment game to earn a payout of game world credits, the skillful execution including placement of symbols into a puzzle of the Sudoku style entertainment game, a user interface that depicts a representation of the puzzle of the Sudoku style entertainment game and receives instructions for placement of symbols within the Sudoku style entertainment game, and a game world engine connected to the entertainment software engine by the network and connected to the real world engine by the communication link and constructed to: monitor Sudoku style entertainment game gameplay for a gambling event occurrence detected from the skillful execution of the Sudoku style entertainment game in accordance with at least one gambling event occurrence rule, communicate the gambling event occurrence to the real world engine, where the gambling event occurrence triggers a wager made in accordance with a wager execution rule within the gambling game executed by the real world engine to produce a wager payout as a randomly generated payout of gameplay resources from the wager, and generate an entertainment game gameplay modification that can be used to modify Sudoku style entertainment game gameplay based upon the wager payout.

In some embodiments, the gambling event occurrence is passage of a period of time during Sudoku style entertainment game gameplay.

In many embodiments, the gambling event occurrence is placement by the player of a symbol in the puzzle.

In various embodiments, the gambling event occurrence is retraction by the player of a placement of a symbol in the puzzle.

In numerous embodiments, the entertainment game modification is an addition of a symbol placement enabling element, the symbol placement enabling element enabling placement by the player of a symbol in the puzzle.

In some embodiments, the entertainment game modification is an addition of a retraction enabling element, the retraction enabling element enabling retraction by the player of a symbol in the puzzle.

In various embodiments, the entertainment game modification is an addition of a period of time available for playing the Sudoku style entertainment game.

In some embodiments, the real world engine and the game world engine are constructed from a same processing apparatus.

In some embodiments, the real world engine and the game world engine are constructed from separate processing apparatuses, and the communication link includes the network.

DETAILED DESCRIPTION

Figure 1:
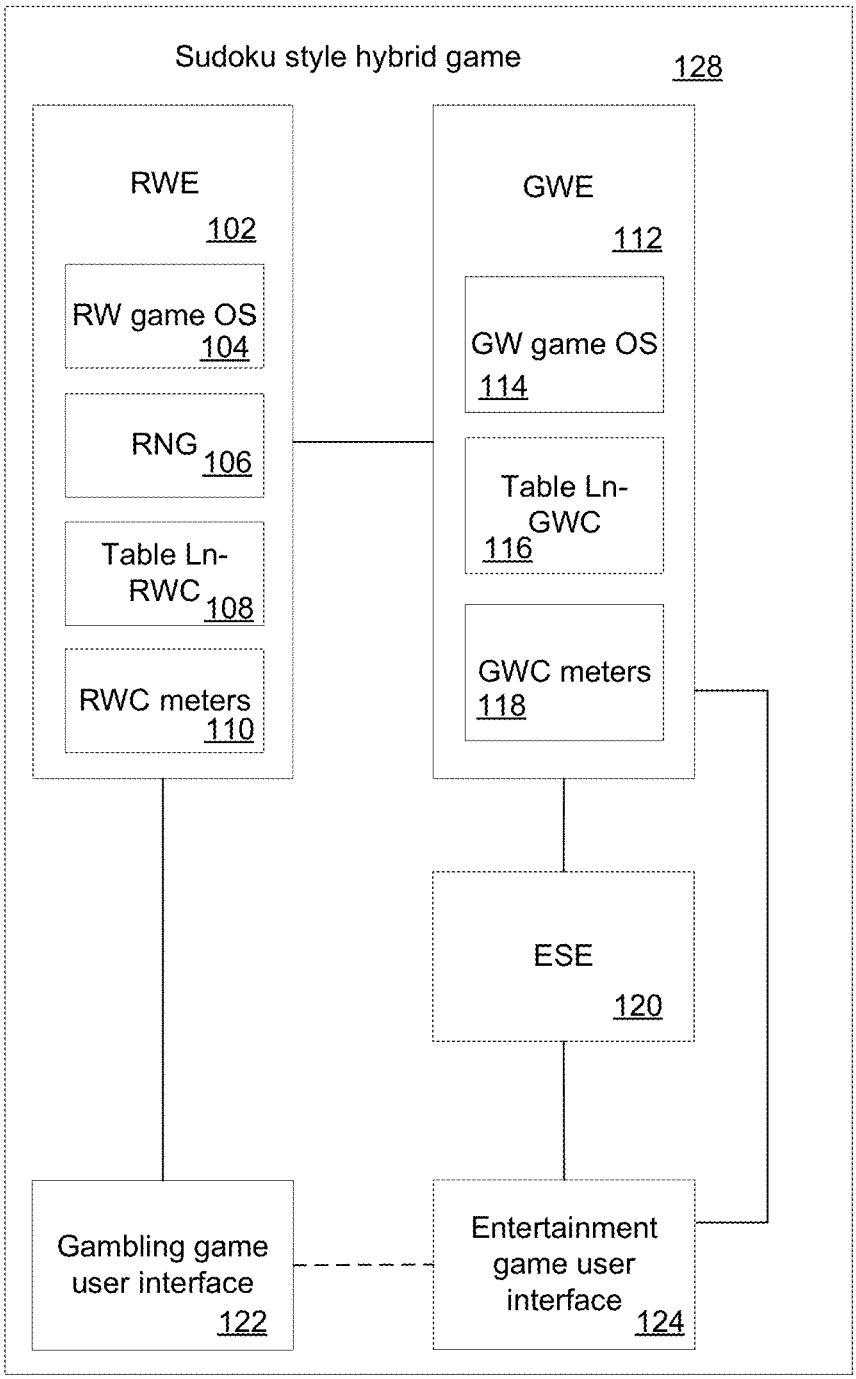
FIG. 1 illustrates a Sudoku style hybrid game in accordance with an embodiment of the invention.

Turning now to the drawings, systems and methods for operation of Sudoku style hybrid games are illustrated. In several embodiments, a Sudoku style hybrid game is a form of a hybrid game that integrates both a gambling game that includes a real world engine (RWE) which manages the gambling game, as well as a Sudoku style entertainment game that includes a game world engine (GWE) which manages the configuration of the Sudoku style entertainment game, and an entertainment software engine (ESE) which executes the Sudoku style entertainment game for user entertainment. In certain embodiments, the Sudoku style hybrid game also includes a user interface associated with either or both the gambling game and the entertainment game. A player of a Sudoku style hybrid game is the electronic representation of interactions, typically via a user interface, associated with a player profile of the Sudoku style hybrid game. In operation of a Sudoku style hybrid game, a player acts upon various types of elements of the entertainment game in a game world environment. In certain embodiments of a Sudoku style hybrid game, a player plays Sudoku against a clock to score points within the context of the Sudoku style entertainment game. In other embodiments, two or more players play against each other in a head-to-head fashion. Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world credits, experience points, or points generally. Wagers can be made in the gambling game using real world credits (RWC). The real world credits can be credits in an actual currency, or can be credits in a virtual currency which has real world value. Gambling outcomes from the gambling game can cause consumption, loss or accrual of RWC. In addition, gambling outcomes in the gambling game can influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RWC value if cashed out of a Sudoku style hybrid game gameplay session. Example elements include enabling elements (EE) which are elements that enable a player's play of the entertainment game and whose consumption by the player while playing the entertainment game can trigger a wager in a gambling game. Another example of an element is a reserve enabling element (REE), which is an element that converts into one or more enabling elements upon occurrence of a release event in hybrid game gameplay. Other types of elements include actionable elements (AE) which are elements that are acted upon to trigger a wager in the gambling game and may or may not be restorable during normal play of the entertainment game. In progressing through entertainment game gameplay, elements can be utilized by a player during interactions with a controlled entity (CE) which is a character, entity, inanimate object, device or other object under control of a player. Also, entertainment game gameplay progress can be dependent upon: a required game object (RGO) which is a specific game object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Although various gameplay resources, such as but not limited to GWC, RWC and elements are discussed above, any gameplay resource can be utilized to advance Sudoku style hybrid game gameplay as appropriate to the specification of a specific application in accordance with embodiments of the invention. Various hybrid games are discussed in Patent Cooperation Treaty Application No. PCT/US11/26768, filed Mar. 1, 2011, entitled ENRICHED GAME PLAY ENVIRONMENT (SINGLE and/or MULTIPLAYER) FOR CASINO APPLICATIONS and Patent Cooperation Treaty Application No. PCT/US11/63587, filed Dec. 6, 2011, entitled ENHANCED SLOT-MACHINE FOR CASINO APPLICATIONS each disclosure of which is hereby incorporated by reference in its entirety.

In many embodiments, a Sudoku style hybrid game integrates a Sudoku style entertainment game with a gambling game. In several embodiments, a Sudoku style hybrid game can utilize a GWE to monitor Sudoku style entertainment game gameplay executed by an ESE for a gambling event occurrence. The gambling event occurrence can be detected from the skillful execution of the Sudoku style entertainment game in accordance with at least one gambling event occurrence rule. The gambling event occurrence can be communicated to a RWE, where the gambling event occurrence triggers a wager made in accordance with a wager execution rule within the gambling game executed by the RWE. The wager can produce a wager payout as a randomly generated payout of gameplay resources. A Sudoku style entertainment game gameplay modification can be generated by the GWE that can be used to modify Sudoku style entertainment game gameplay executed by the ESE based upon the wager payout. In various embodiments, Sudoku style entertainment game gameplay can advance through the performance of Sudoku style player actions, where a Sudoku style player action is an action during Sudoku style hybrid game gameplay that can be performed by a player or to a player.

In several embodiments, a gambling event occurrence can be any occurrence within a Sudoku style entertainment game used to trigger a wager in a gambling game. A gambling event occurrence can include, but is not limited to, passage of a period of time during Sudoku style entertainment game gameplay, a result from a Sudoku style entertainment game gameplay session (such as but not limited to achieving a goal or a particular score), a player action that is a consumption of an element, or a player action that achieves a combination of elements to be associated with a player profile.

In numerous embodiments, an entertainment game modification is an instruction of how to modify Sudoku style entertainment game gameplay based upon a wager payout.

An entertainment game modification can modify any aspect of a Sudoku style entertainment game, such as but is not limited to an addition of a period of time available for a current Sudoku style entertainment game gameplay session, an addition of a period of time available for a future Sudoku style entertainment game gameplay session or any other modification to elements that can be utilized in Sudoku style entertainment game gameplay. In certain embodiments, an entertainment game modification can modify a type of element whose consumption is a gambling event occurrence. In particular embodiments, an entertainment game modification can modify a type of element whose consumption is not required in a gambling event occurrence.

In a number of embodiments, a user interface can be utilized that depicts a status of the Sudoku style entertainment game. A user interface can depict any aspect of a Sudoku style entertainment game including, but not limited to, an illustration of Sudoku style entertainment game gameplay advancement as a player plays Sudoku.

Sudoku style hybrid games in accordance with embodiments of the invention are discussed below.

Sudoku Style Hybrid Games

In many embodiments, a Sudoku style hybrid game integrates high-levels of entertainment content with a game of skill (Sudoku style entertainment game) and a gambling experience with a game of chance (gambling game). A Sudoku style hybrid game provides for random outcomes independent of player skill while providing that the user's gaming experience (as measured by obstacles/challenges encountered, time of play and other factors) is shaped by the player's skill. A Sudoku style hybrid game in accordance with an embodiment of the invention is illustrated in FIG. 1. The Sudoku style hybrid game 128 includes a RWE 102, GWE 112, ESE 120, gambling game user interface 122 and Sudoku style entertainment game user interface 124. The two user interfaces can be part of the same user interface but are separate in the illustrated embodiment. The RWE 102 is connected with the GWE 112 and the gambling game user interface 122. The ESE 120 is connected with the GWE 112 and the Sudoku style entertainment game user interface 124. The GWE 112 is connected also with the Sudoku style entertainment game user interface 124.

In several embodiments, the RWE 102 is the operating system for the gambling game of the Sudoku style hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator (RNG) 106, level n real-world credit pay tables (table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RWC) 108 is a table that can be used in conjunction with a random number generator or pseudo random number generator (RNG) 106 to dictate the real world credits (RWC) earned as a function of Sudoku style hybrid game gameplay and is analogous to the pay tables used in a conventional slot machine. Table Ln-RWC payouts are independent of player skill. There can be one or a plurality of table Ln-RWC pay tables 108 contained in a gambling game, the selection of which can be determined by factors including (but not limited to) game progress a player has earned, and/or bonus rounds which a player can be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the table Ln-RWC real world credits pay table 108, independent of player skill. In certain embodiments, an amount of RWC can be used as criteria in order to enter higher Sudoku style entertainment game levels. RWC can be carried forward to higher game levels or paid out if a cash out is opted for by a player. The amount of RWC used to enter a specific level of the game level n need not be the same for each level.

In many embodiments, the GWE 112 manages the overall Sudoku style hybrid game operation, with the RWE 102 and the ESE 120 effectively being support units to the GWE 112. In several embodiments, the GWE 112 may include mechanical, electronic and software system for a Sudoku style entertainment game. The GWE 112 includes an operating system (OS) 114 that provides control of the Sudoku style entertainment game. The GWE additionally may include a level n game world credit pay table (table Ln-GWC) 116 from where to take input from this table to affect the play of the Sudoku style entertainment game. The GWE 112 can further couple to the RWE 102 to determine the amount of RWC available on the game and other metrics of wagering on the gambling game (and potentially affect the amount of RWC in play on the RWE). The GWE additionally may include various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level n game world credit pay table (table Ln-GWC) 116 dictates the GWC earned as a function of player skill in the nth level of the game. The payouts governed by this table are dependent upon player skill and Sudoku style hybrid game gameplay at large and can or cannot be coupled to a random number generator. In several embodiments, game world credits (GWC) are player points earned or depleted as a function of player skill, specifically as a function of player performance in the context of the game. GWC may be analogous to the score in a typical video game. A Sudoku style entertainment game can have one or more scoring criterion, embedded within the table Ln-GWC 116 that reflects player performance against the goal(s) of the Sudoku style entertainment game. GWC can be carried forward from one level of sponsored gameplay to another, and ultimately paid out in various manners such as directly in cash, or indirectly such as by earning entrance into a sweepstakes drawing, or earning participation in, or victory in, a tournament with prizes. GWC can be stored on a player tracking card or in a network-based player tracking system, where the GWC is attributed to a specific player.

In certain embodiments, the operation of the GWE does not affect the RWE's gambling operation except for player choice parameters that are allowable in slot machines including but not limited to wager terms such as but not limited to a wager amount, how fast the player wants to play (by pressing a button or pulling the handle of a slot machine) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this can be utilized to communicate certain Sudoku style entertainment game club points, player status, control the selection of choices and messages which a player can find useful in order to adjust the a Sudoku style entertainment game experience or understand their gambling status in the RWE 102.

In various embodiments, the ESE 120 manages and controls the visual, audio, and player control for the Sudoku style entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a casino gaming device such as a cabinet based casino game, a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a Sudoku style hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain a Sudoku style entertainment game control parameters to the ESE 120 to affect its play, such as (but not limited to) changing the difficulty level of the game. These game control parameters can be based on a gambling outcome of a gambling game that was triggered by an element in the Sudoku style entertainment game being acted upon by the player. The ESE 120 can accept this input from the GWE 112, make adjustments, and continue Sudoku style entertainment game gameplay all the while running seamlessly from the player's perspective. The ESE's operation is mostly skill based, except for where the ESE's processes can inject complexities into the game by chance in its normal operation to create unpredictability in the Sudoku style entertainment game. Utilizing this interface, the ESE 120 can also communicate player choices made in the game to the GWE 112, such as but not limited to selection of entry of symbols into the Sudoku puzzle board. The GWE's job in this architecture, being interfaced thusly to the ESE 120, is to allow the transparent coupling of an Sudoku style entertainment game to a fair and transparent random chance gambling game, providing a seamless perspective to the player that they are playing a typical popular Sudoku style entertainment game (which is skill based).

In several embodiments, the RWE 102 can accept a trigger to run a gambling game in response to actions taken by the player in the Sudoku style entertainment game as conveyed by the ESE 120 to the GWE 112, or as triggered by the GWE 112 based on its algorithms, background to the overall hybrid game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include but is not limited to gameplay using a more difficult Sudoku board layout. These choices can increase or decrease the amount wagered per individual gambling game, in the same manner that a standard slot machine player can decide to wager more or less credits for each pull of the handle. In several embodiments, the RWE 102 can communicate a number of factors back and forth to the GWE 112, via an interface, such that an increase/decrease in a wagered amount can be related to the player's decision making as to their player profile in the Sudoku style entertainment game. In this manner, a player can be in control of a per game wager amount, with the choice mapping to a parameter or component that is applicable to the Sudoku style entertainment game experience. In a particular embodiment, the RWE 102 operation can be a game of chance as a gambling game running every 10 seconds where the amount wagered is communicated from the GWE 112 as a function of choices the player makes in the player's player profile in the Sudoku style entertainment game.

In many embodiments, a Sudoku style hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate gamers can be established with the entertainment game. In several embodiments, the Sudoku style hybrid game can leverage popular titles with gamers and provides a sea change environment for casinos to attract players with games that are more akin to the type of entertainment that a younger generation desires. In various embodiments, players can use their skill towards building and banking GWC that in turn can be used to win tournaments and various prizes as a function of their gamer process. Numerous embodiments minimize the underlying changes applied to the aforementioned entertainment software for the hybrid game to operate within a Sudoku style entertainment game construct. Therefore, a plethora of complex game titles and environments can be rapidly and inexpensively to deployed in a gambling environment.

In certain embodiments, Sudoku style hybrid games also allow players to gain entry into subsequent competitions through the accumulation of game world credits (GWC) as a function of the user's demonstrated skill at the game. These competitions can pit individual players or groups of players against one another and/or against the operator of a gambling game (such as but not limited to a casino) to win prizes based upon a combination of chance and skill. These competitions can be either asynchronous events, whereby players participate at a time and/or place of their choosing, or they can be synchronized events, whereby players participate at a specific time and/or venue.

In many embodiments, one or more players can be engaged in playing a skill based Sudoku style entertainment game executed by the ESE. A Sudoku style hybrid game can include an entertainment game that includes head to head play between a single player and the computer, between two or more players against one another, or multiple players playing against the computer and/or each other, as well as a process by which player can bet on the outcome of an Sudoku style entertainment game. The Sudoku style entertainment game can also be a game where the player is not playing against the computer or any other player, such as in games where the player is effectively playing against himself or herself.

Figure 2:
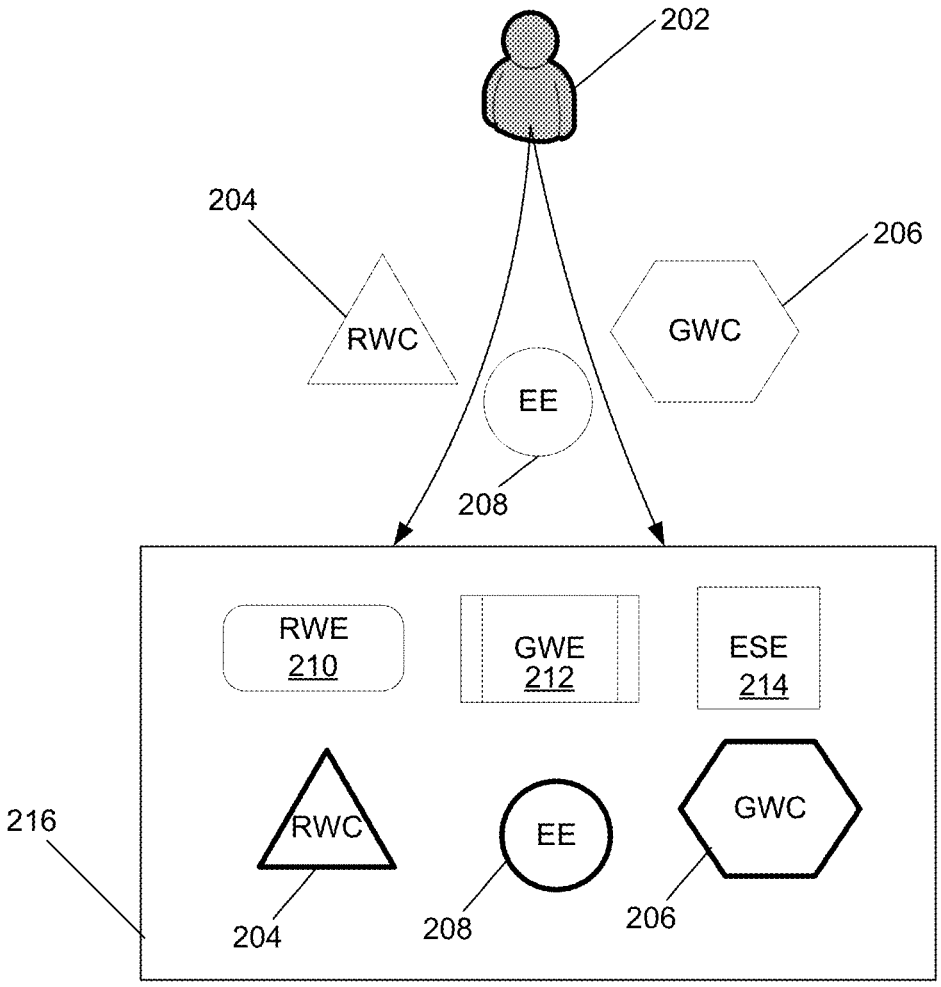
FIG. 2 is a conceptual diagram that illustrates how resources are utilized in a Sudoku style hybrid game in accordance with an embodiment of the invention.

In several embodiments, a player can interact with a Sudoku style hybrid game by using RWC in interactions with a gambling game along with GWC and elements in interactions with a Sudoku style entertainment game. The gambling game can be executed by a RWE while a Sudoku style entertainment game can be executed with an ESE and managed with a GWE. A conceptual diagram that illustrates how resources such as GWC, RWC and elements, such as but not limited to EE, are utilized in a Sudoku style hybrid game in accordance with an embodiment of the invention is illustrated in FIG. 2. The conceptual diagram illustrates that RWC 204, EE 208 and GWC 206 can be utilized by a player 202 in interactions with the RWE 210, GWE 212 and ESE 214 of a Sudoku style hybrid game 216. The contribution of elements, such as EE 208, can be linked to a player's access to credits, such as RWC 204 or GWC 206. Electronic receipt of these credits can come via a smart card, voucher or other portable media, or as received over a network from a server. In certain implementations, these credits can be drawn on demand from a player profile located in a database locally on a Sudoku style hybrid game or in a remote server.

Figure 3:
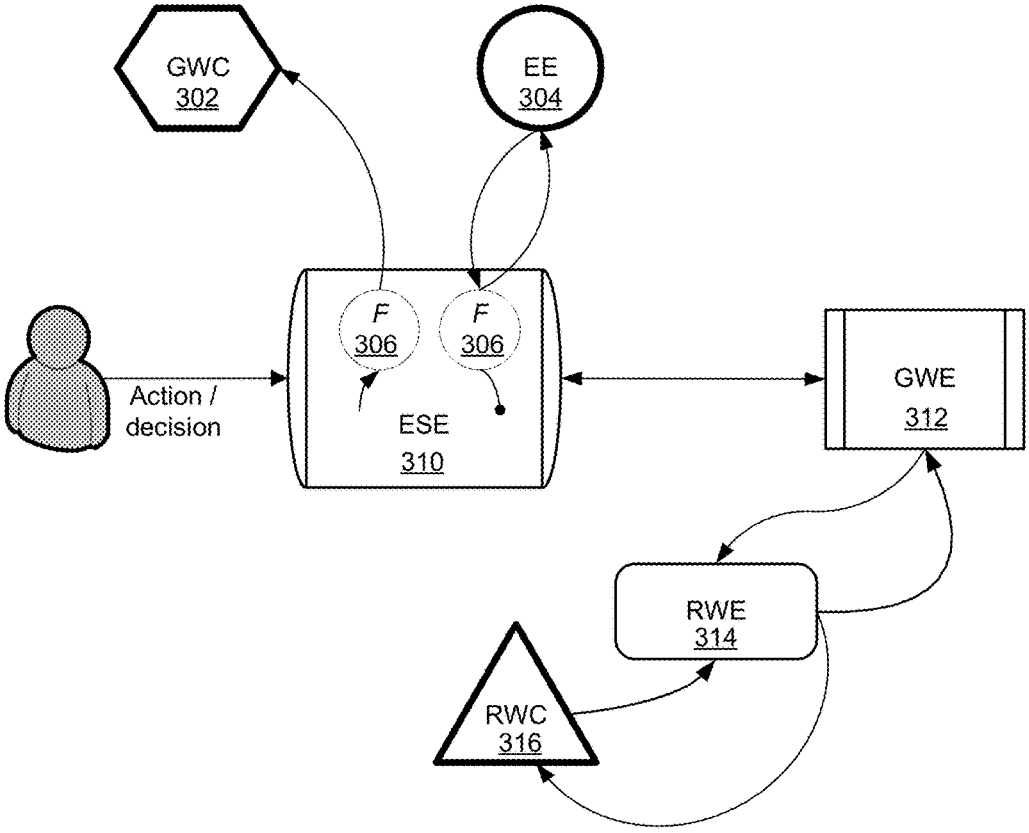
FIG. 3 is a conceptual diagram that illustrates interplay between resources and components of a Sudoku style hybrid game in accordance with an embodiment of the invention.

A conceptual diagram that illustrates interplay between elements and components of a Sudoku style hybrid game in accordance with an embodiment of the invention is illustrated in FIG. 3. Similar to FIG. 2, a player's actions and/or decisions can affect functions 306 that consume and/or accumulate GWC 302 and/or EE 304 in a Sudoku style entertainment game executed by an ESE 310. A GWE 312 can monitor the activities taking place within a Sudoku style entertainment game executed by an ESE 310 for gameplay gambling event occurrences. The GWE 312 can also communicate the gameplay gambling event occurrences to an RWE 314 that triggers a wager of RWC 316 in a gambling game executed by the RWE 314.

Figure 4:
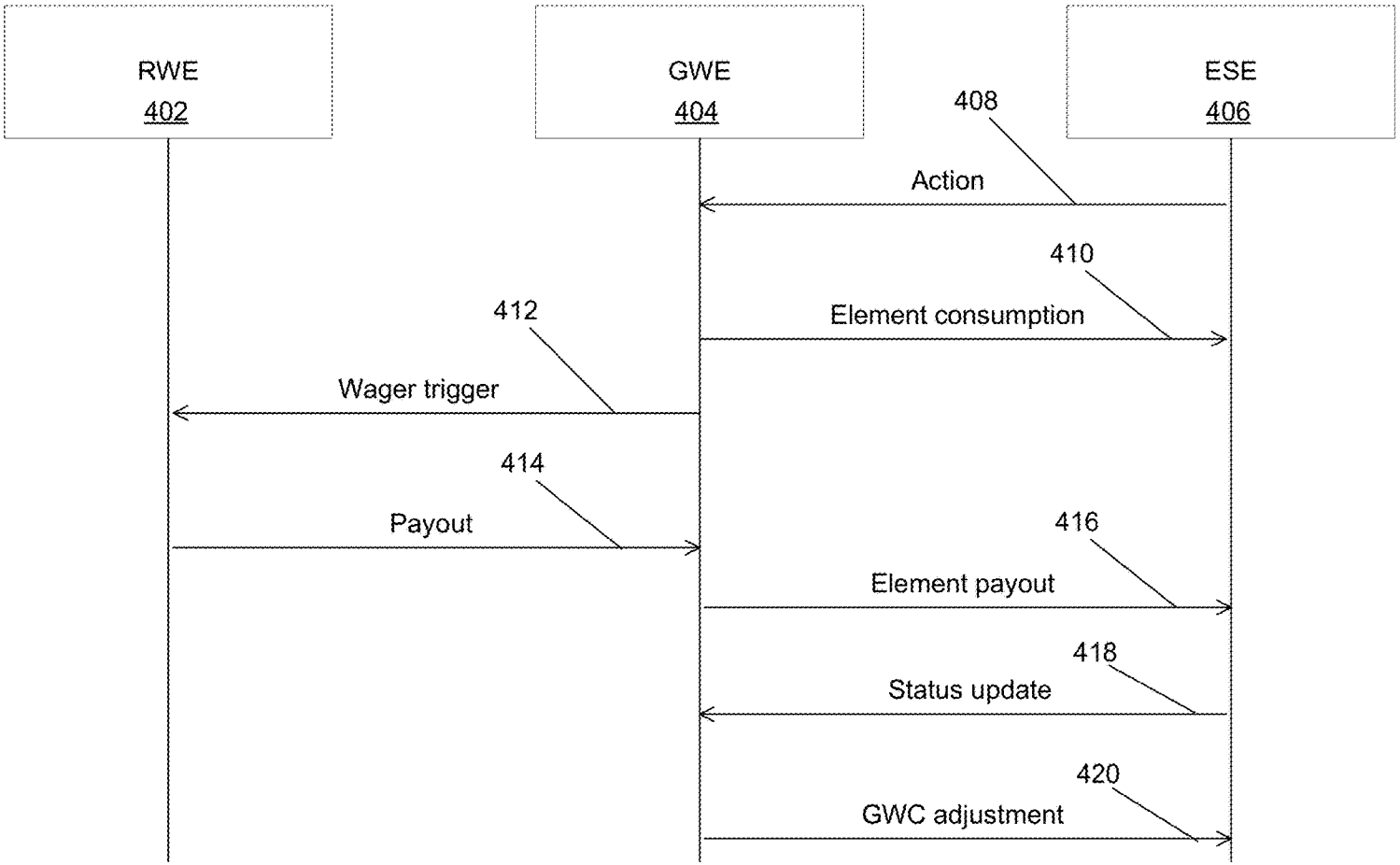
FIG. 4 is a timing diagram that illustrates a process of facilitating interactions between a Sudoku style entertainment game and a gambling game in accordance with an embodiment of the invention.

A timing diagram that illustrates a process of facilitating interactions between a Sudoku style entertainment game and a gambling game in accordance with embodiments of the invention is illustrated in FIG. 4. The process includes a player performing a player action using a user interface. An ESE 406 can signal (408) a GWE 404 of the player action. The GWE 404 can signal (410) the ESE 406 as to the amount of EE that will be consumed by the player action in return. The signal can configure a function that controls EE consumption, decay or addition for the ESE. The ESE 406 can, based upon the function, consume an amount of EE designated by the GWE 404 to couple to the activity. Upon detection that the player action is a gameplay gambling event, the GWE 404 can signal an RWE 402 as to the wager terms associated with the gameplay gambling event in a triggered (412) wager. The RWE 402 can consume RWC in executing the wager. The RWE 402 can return RWC as a payout from the wager. The RWE 402 can inform (414) the GWE 404 as to the payout from the wager. The GWE 404 can signal (416) the ESE 406 to ascribe a payout of EE based upon the wager. The ESE 406 can reconcile and combine the payout of EE with the EE already ascribed to the player in the Sudoku style entertainment game. The ESE 406 can signal (408) the GWE 404 as to its updated status based upon reconciling the payout of EE, and the GWE 404 can signal the ESE 406 of a payout of GWC in response (420) to the status update.

In certain embodiments, the sequence of events in the timing diagram of FIG. 4 can be reflected in a first person Sudoku style entertainment game. For example, a player can select a number to be placed in a section of a Sudoku board. The ESE can signal (408) the GWE of the player action, such as but not limited to signaling the GWE as to the player's choice of the symbol, the position on the Sudoku puzzle board that the symbol is played and whether or not the symbol as played was a correct symbol in terms of eventually solving the Sudoku puzzle. The GWE can process the information concerning the placement of the symbol, and signal (410) the ESE to consume a symbol (EE) with each placement. The entertainment game then will consume the numbe3r (EE) based upon the placement of the symbol. The GWE can also signal (412) the RWE that 3 credits of RWC are to be wagered to match the placement of the symbol as (EE) that is consumed, on a particular pay table (table Ln-RC). The RWE can consume the 3 credits for the wager and execute the specified wager. In executing the wager, the RWE can determine that the player hits a jackpot of 6 credits, and allocate the 6 credits of RWC to the credit meter. The RWE can also inform (414) the GWE that 6 credits of RWC net were won as a payout from the wager. The GWE can signal (416) the ESE to add 2 additional symbols (EE) to the symbol of symbols available to a player based upon the gambling game payout. The ESE can then add 2 symbols (EE) to the number of symbol placements available to a player in the Sudoku style entertainment game. The GWE can receive (418) an update from the ESE as to the total amount of EE associated with the player. The GWE can log the new player score (GWC) in the game (as a function of the successful placement of the symbol) based on the update, and signal (420) the ESE to add 2 extra points of GWC to the player's score.

In many embodiments, a player can bet on whether or not the player will beat another player. These bets can be made, for example, on the final outcome of the game, and/or the state of the game along various intermediary points (such as but not limited to the score at the end of a period of time of a Sudoku style entertainment game session) and/or on various measures associated with the game. Players can bet against one another, or engage the computer in a head to head competition in the context of their skill level in the Sudoku style entertainment game in question. As such, players can have a handicap associated with their player profile that describes their skill (which can be their professed skill in certain embodiments), and which is used by a GWE (such as a local GWE or a GWE that receives services from remote servers) to offer appropriate bets around the final and/or intermediate outcomes of the Sudoku style entertainment game, and/or to condition sponsored gameplay as a function of player skill, and/or to select players across one or more Sudoku style hybrid games to participate in head to head games and/or tournaments.

Many embodiments enable the maximization of the number of players able to compete competitively by enabling handicapping of players by utilizing a skill normalization module that handicaps players to even the skill level of players competing against each other. Handicapping enables players of varying performance potential to compete competitively regardless of absolute skill level, such as but not limited to where a player whose skill level identifies the player as a beginner can compete in head to head or tournament play against a highly skilled player with meaningful results.

In several embodiments, wagers can be made among numerous Sudoku style hybrid games with a global betting manager (GBM). The GBM is a system that coordinates wagers that are made across multiple Sudoku style hybrid games by multiple players. In some implementations it can also support wagers by third parties relative to the in game performance of other players. The GBM can stand alone, or is capable of being embedded in one of a number of systems, including a GWE, ESE or any remote server capable of providing services to a Sudoku style hybrid game, or can operate independently on one or a number of servers on-site at a casino, as part of a larger network and/or the Internet or cloud in general.

Although various components of Sudoku style hybrid games are discussed above, Sudoku style hybrid games can be configured with any component as appropriate to the specification of a specific application in accordance with embodiments of the invention. In certain embodiments, components of a Sudoku style hybrid game, such as a GWE, RWE, ESE can be configured in different ways for a specific Sudoku style hybrid game gameplay application. Network connected Sudoku style hybrid games are discussed below.

Network Connected Sudoku Style Hybrid Games

Sudoku style hybrid games in accordance with many embodiments of the invention can operate locally while being network connected to draw services from remote locations or to communicate with other Sudoku style hybrid games. In many embodiments, operations associated with a Sudoku style hybrid game utilizing a Sudoku style entertainment game can be performed across multiple devices. These multiple devices can be implemented using a single server or a plurality of servers such that a Sudoku style hybrid game is executed as a system in a virtualized space, such as (but not limited to) where the RWE and GWE are large scale centralized servers in the cloud coupled to a plurality of widely distributed ESE controllers or clients via the Internet.

In many embodiments, a RWE server can perform certain functionalities of a RWE of a Sudoku style hybrid game. In certain embodiments, a RWE server includes a centralized odds engine which can generate random outcomes (such as but not limited to win/loss outcomes) for a gambling game. The RWE server can perform a number of simultaneous or pseudo-simultaneous runs in order to generate random outcomes for a variety of odds percentages that one or more networked Sudoku style hybrid games can use. In certain embodiments, an RWE of a Sudoku style hybrid game can send information to a RWE server including (but not limited to) table Ln-RWC tables, maximum speed of play for a gambling game, gambling game monetary denominations or any promotional RWC provided by the operator of the Sudoku style hybrid game. In particular embodiments, a RWE server can send information to a RWE of a Sudoku style hybrid game including (but not limited to) RWC used in the gambling game, player profile information or play activity and a profile associated with a player.

In several embodiments, a GWE server can perform the functionality of the GWE across various Sudoku style hybrid games. These functionalities can include (but are not limited to) providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GWE server. A patron management server can manage information related to a player profile, including (but not limited to) data concerning controlled entities (such as characters used by a player in Sudoku style entertainment game gameplay), game scores, elements, RWC and GWC associated with particular players and managing tournament reservations. Although a patron management server is discussed separate from a GWE server, in certain embodiments a GWE server also performs the functions of a patron management server. In certain embodiments, a GWE of a Sudoku style hybrid game can send information to a patron management server including (but not limited to) GWC and RWC used in a game, player profile information, play activity and profile information for players and synchronization information between a gambling game and a Sudoku style entertainment game or other aspects of a Sudoku style hybrid game. In particular embodiments, a patron management server can send information to a GWE of a Sudoku style hybrid game including (but not limited to) Sudoku style entertainment game title and type, tournament information, table Ln-GWC tables, special offers, character or profile setup and synchronization information between a gambling game and an Sudoku style entertainment game or other aspects of a Sudoku style hybrid game.

In numerous embodiments, an ESE server provides a host for managing head to head play, operating on the network of ESEs which are connected to the ESE server by providing an environment where players can compete directly with one another and interact with other players. Although an ESE server is discussed separate from a GWE server, in certain embodiments the functionalities of an ESE server and GWE server can be combined in a single server.

Servers connected via a network to implement Sudoku style hybrid games in accordance with many embodiments of the invention can communicate with each other to provide services utilized by a Sudoku style hybrid game. In several embodiments a RWE server can communicate with a GWE server. A RWE server can communicate with a GWE server to communicate any type of information as appropriate for a specific application, including (but not limited to): information used to configure the various simultaneous or pseudo simultaneous odds engines executing in parallel within the RWE to accomplish Sudoku style hybrid game system functionalities, information used to determine metrics of RWE performance such as random executions run and outcomes for tracking system performance, information used to perform audits, provide operator reports, and information used to request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server during a Sudoku style hybrid game tournament. Typically a GWE (such as a GWE that runs within a Sudoku style hybrid game or on a GWE server) is not aware of the relationship of itself to the rest of a tournament since in a typical configuration the actual tournament play is managed by the ESE server. Therefore, management of a Sudoku style hybrid game tournament can include (but is not limited to) tasks such as: conducting tournaments according to system programming that can be coordinated by an operator of the Sudoku style hybrid game; allowing entry of a particular player into a tournament; communicating the number of players in a tournament and the status of the tournament (such as but not limited to the amount of surviving players, their status within the game, time remaining on the tournament); communicating the performance of its players within the tournament; communicating the scores of the various members in the tournament; and providing a synchronizing link to connect the GWEs in a tournament with their respective ESEs.

In several embodiments a GWE server can communicate with a patron management server. A GWE server can communicate with a patron management server to communicate any type of information as appropriate for a specific application, including (but not limited to) information for configuring tournaments according to system programming conducted by an operator of a Sudoku style hybrid game, information for exchange of data used to link a player's player profile to their ability to participate in various forms of Sudoku style hybrid game gameplay (such as but not limited to the difficulty of play set by the GWE server or the GWE), information for determining a player's ability to participate in a tournament as a function of a player's characteristics (such as but not limited to a player's gaming prowess or other metrics used for tournament screening), information for configuring GWE and ESE performance to suit preferences of a player on a particular Sudoku style hybrid game, information for determining a player's play and gambling performance for the purposes of marketing intelligence, and information for logging secondary drawing awards, tournament prizes, RWC and GWC into the player profile.

In many embodiments, the actual location of where various algorithms and functions are executed can be located either in the game contained devices (RWE, GWE, ESE), on the servers (RWE server, GWE server, or ESE server), or a combination of both game contained devices and servers. In particular embodiments, certain functions of a RWE server, GWE server, patron management server or ESE server can operate on the local RWE, GWE or ESE contained with a Sudoku style hybrid game locally. In certain embodiments, a server can be part of a server system including a plurality of servers, where software can be run on one or more physical devices. Similarly, in particular embodiments, multiple servers can be combined on a single physical device.

Figure 5:
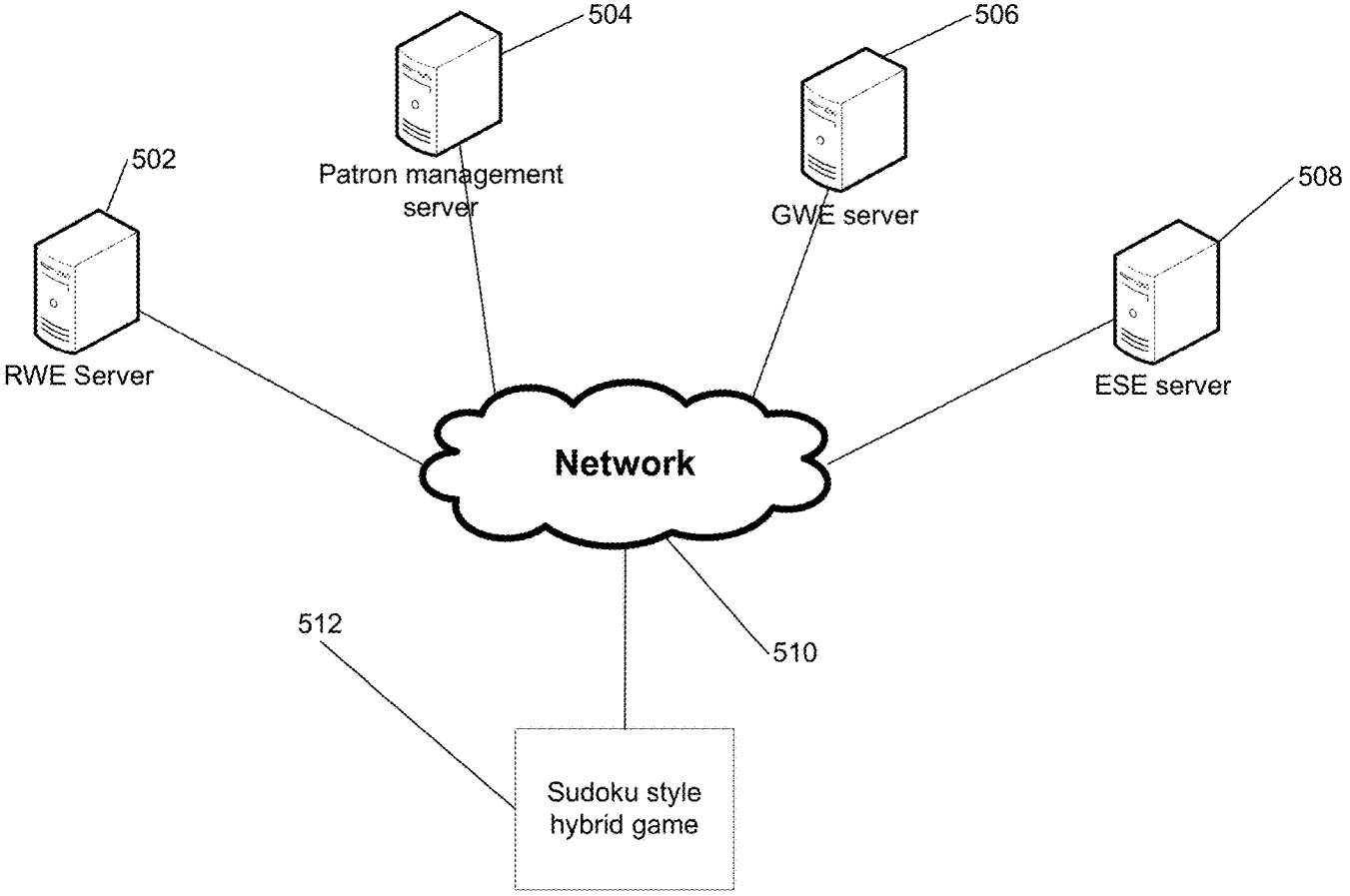
FIG. 5 is a system diagram that illustrates a network distributed Sudoku style hybrid game in accordance with an embodiment of the invention.

Sudoku style hybrid games in accordance with many embodiments of the invention can be networked with remote servers in various configurations. A networked Sudoku style hybrid game in accordance with an embodiment of the invention is illustrated in FIG. 5. The networked Sudoku style hybrid game 512 is connected with a RWE server 502, patron management server 504, GWE server 506, ESE server 508 and a Sudoku style hybrid game server 514 over a network 510, such as (but not limited to) the Internet. Servers networked with a networked Sudoku style hybrid game 512 can also communicate with each of the components of a networked Sudoku style hybrid game and amongst the other servers in communication with the networked Sudoku style hybrid game 512.

Figure 6:
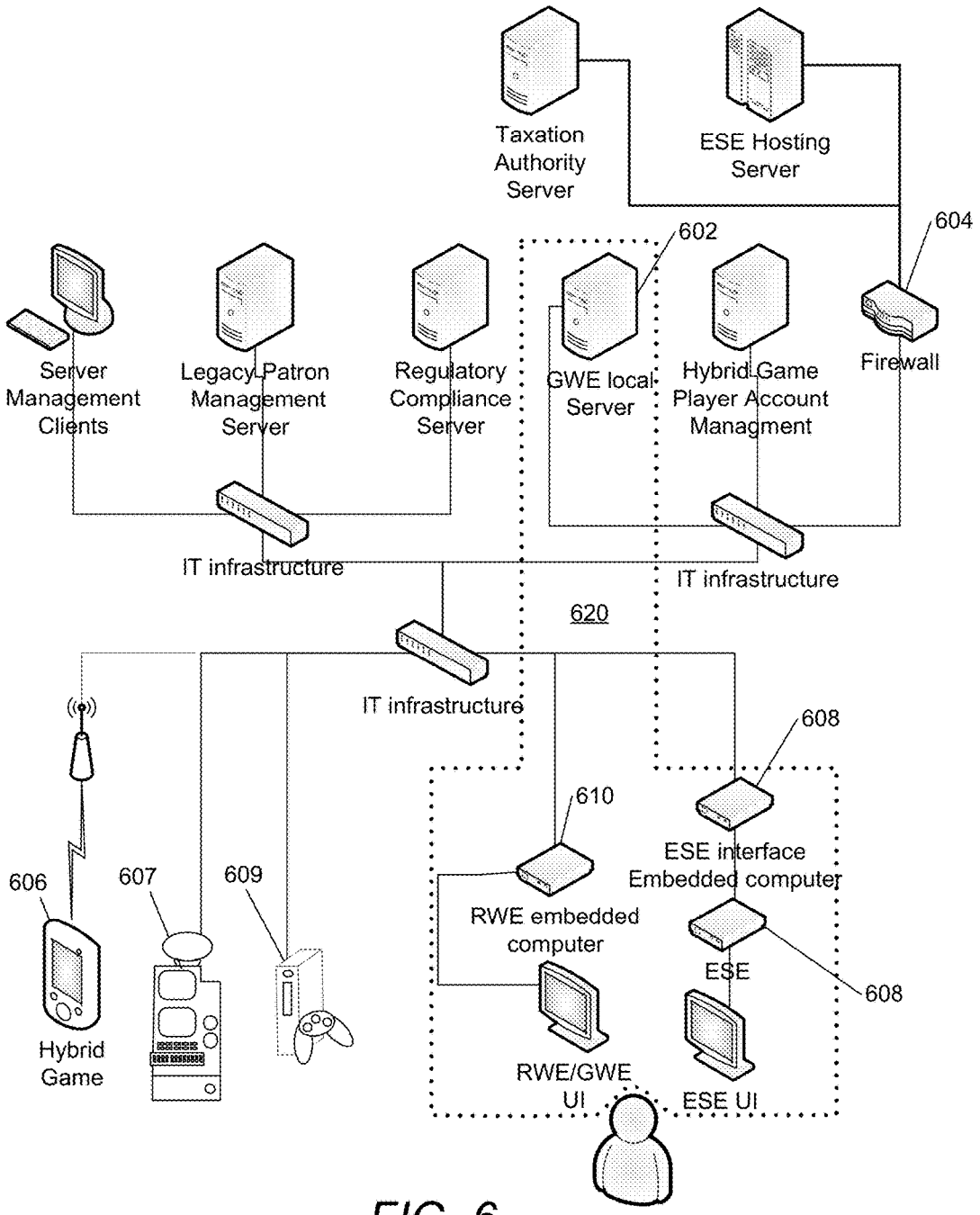
FIG. 6 is a system diagram that illustrates an implementation of a network distributed Sudoku style hybrid game with a local device user interface in accordance with an embodiment of the invention.

A system diagram that illustrates an implementation of a network distributed Sudoku style hybrid game with a GWE local server in accordance with an embodiment of the invention is illustrated in FIG. 6. The system includes several Sudoku style hybrid games running on separate devices, such as a mobile device such as a smartphone or tablet computer 606, a casino gaming cabinet 607 and a personal computer or gaming console 609, sharing services from the same GWE local server 602 over a network. The several Sudoku style hybrid games can be implemented on any device, including laptops, desktop computers, mobile phones, tablets over a wireless connection. A single Sudoku style hybrid game 620 with a RWE 610, ESE 608 and GWE 602 is enclosed within a dotted line. A number of other peripheral systems, such as player management, casino management, regulatory, and hosting servers can also interface with the Sudoku style hybrid games over a network within an operator's firewall 604. Also, other servers can reside outside the bounds of a network within an operator's firewall 604 to provide additional services for network connected Sudoku style hybrid games.

Figure 7:
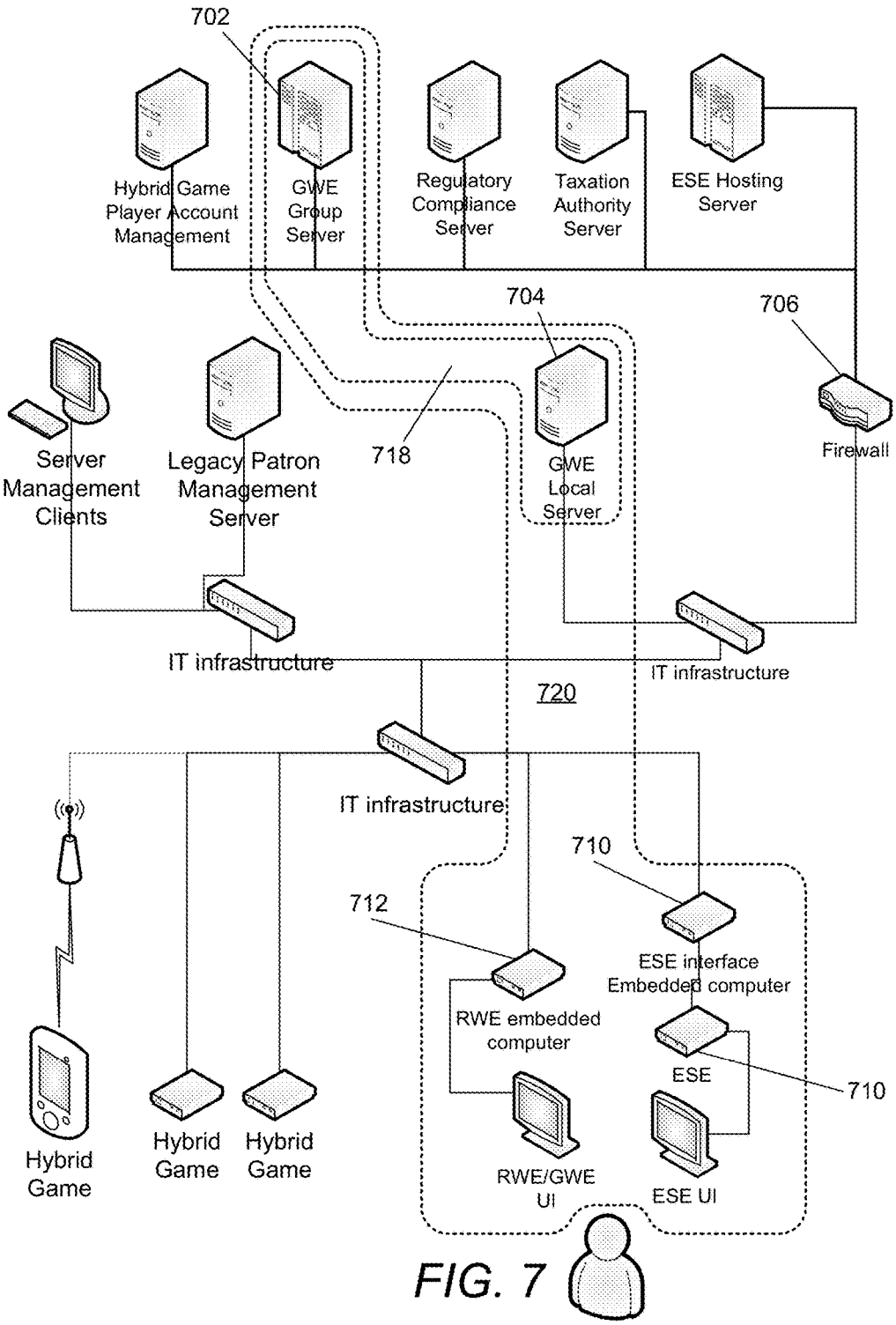
FIG. 7 is a system diagram that illustrates an implementation of a network distributed Sudoku style hybrid game including a game world engine group server in accordance with an embodiment of the invention.

A system diagram that illustrates an implementation of a network distributed hybrid game with a GWE local server and a GWE group server in accordance with an embodiment of the invention is illustrated in FIG. 7. This system includes a Sudoku style hybrid game with a RWE 712, ESE 710 and GWE local server 704 enclosed within an area 720 with a but where a single hybrid game can call upon services from servers within an operator's firewall 706 (such as but not limited to a GWE local server) as well as beyond an operator's firewall 706 (such but not limited to a GWE group server 702). The GWE group server 702 can coordinate multiple Sudoku style hybrid games from across a network that spans beyond an operator's firewall 706. A GWE server system 718 can include multiple GWE servers, such as but not limited to a GWE local server 704 and a GWE group server 702. Multiple network connected hybrid games can be implemented using various computing devices (such as but not limited to laptops, desktop computers, mobile phones, PDAs or tablets) and be connected to various servers to call upon services that enable the execution of the hybrid game.

Figure 8:
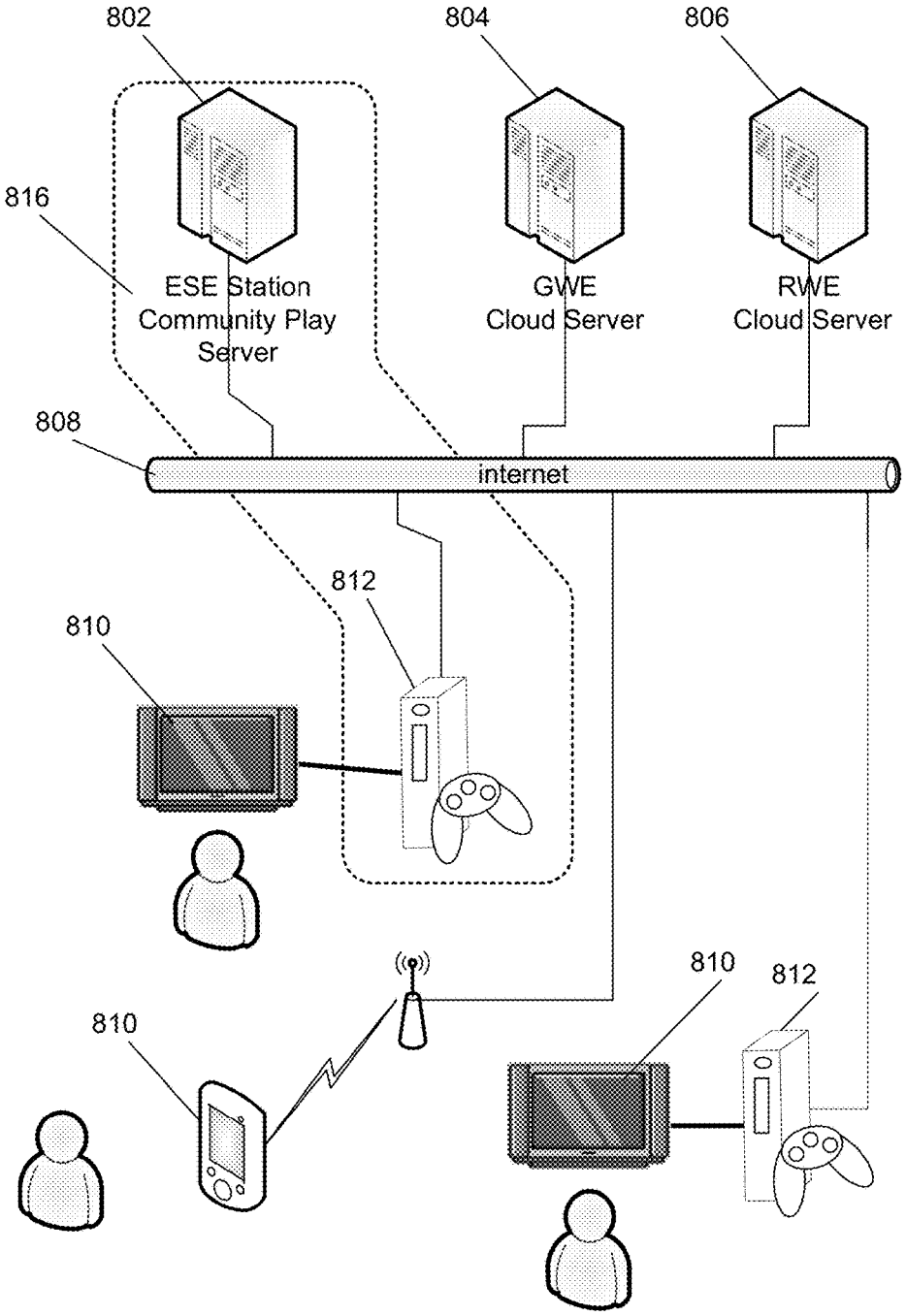
FIG. 8 is a system diagram that illustrates an implementation of an Internet distributed Sudoku style hybrid game in accordance with an embodiment of the invention.

A system diagram that illustrates an implementation of network distributed hybrid games over the Internet in accordance with an embodiment of the invention is illustrated in FIG. 8. The system includes an ESE server 802, GWE server 804 and RWE server 806 that connects to a user interface 810 (such as but not limited to a television screen, computer terminal, tablet, touchscreen or PDA) of Sudoku style hybrid games over the Internet 808. Each Sudoku style hybrid game includes a local ESE 812 that also interfaces with a remote ESE server 802. In certain embodiments, the user interface and local ESE are combined in a single device. Processes performed by an ESE 816 can be performed in multiple locations, such as but not limited to remotely on an ESE server 802 and locally on a local ESE 812.

Figures 1, 9:
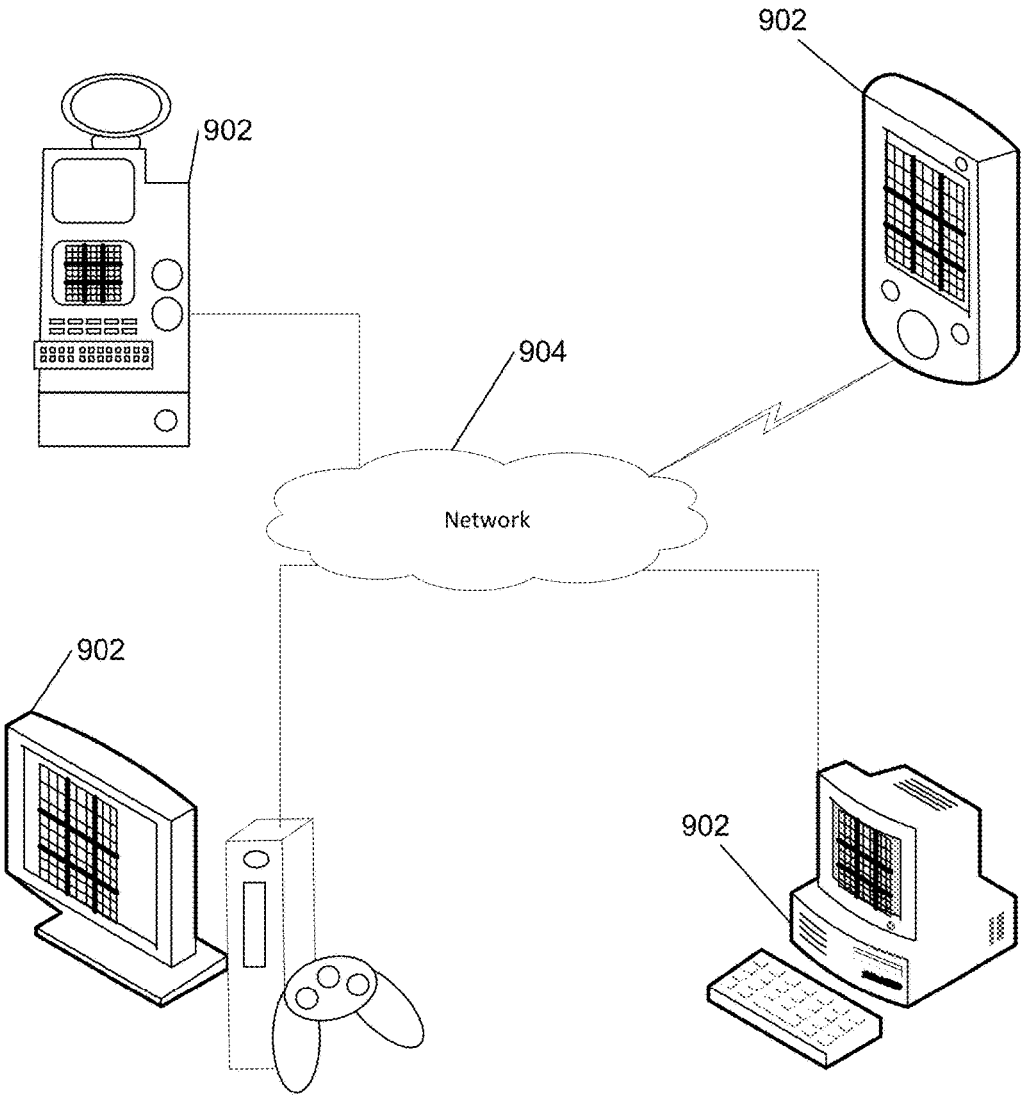
FIG. 9 is a system diagram that illustrates an implementation of a network distributed Sudoku style hybrid game on multiple devices in accordance with an embodiment of the invention.

In numerous embodiments, a network distributed Sudoku style hybrid game can be implemented on multiple different types of devices connected together over a network. Any type of device can be utilized in implementing a network distributed Sudoku style hybrid game, such as but not limited to a gaming cabinet as used in a traditional land-based casino or a mobile computing device (such as but not limited to a PDA, smartphone, tablet computer or laptop computer), a game console (such as but not limited to a Sony PlayStation®, or Microsoft Xbox®) or on a Personal Computer (PC). Each of the devices may be operatively connected to other devices or other systems of devices via a network for the playing of head-to-head games. A system diagram that illustrates an implementation of a network distributed Sudoku style hybrid game on multiple devices in accordance with an embodiment of the invention is illustrated in FIG. 9. The network distributed Sudoku style hybrid game includes multiple Sudoku style entertainment games of a Sudoku style hybrid game executing on different types of devices 902 and connected together over a network 904.

Although various networked Sudoku style hybrid games are discussed above, Sudoku style hybrid games can be networked in any configuration as appropriate to the specification of a specific application in accordance with embodiments of the invention. In certain embodiments, components of a networked Sudoku style hybrid game, such as a GWE, RWE, ESE or servers that perform services for a GWE, RWE or ESE, can be networked in different configurations for a specific networked Sudoku style hybrid game gameplay application. Sudoku style hybrid game implementations are discussed below.

Sudoku Style Hybrid Game Implementations

Game Set Up

Figure 10:
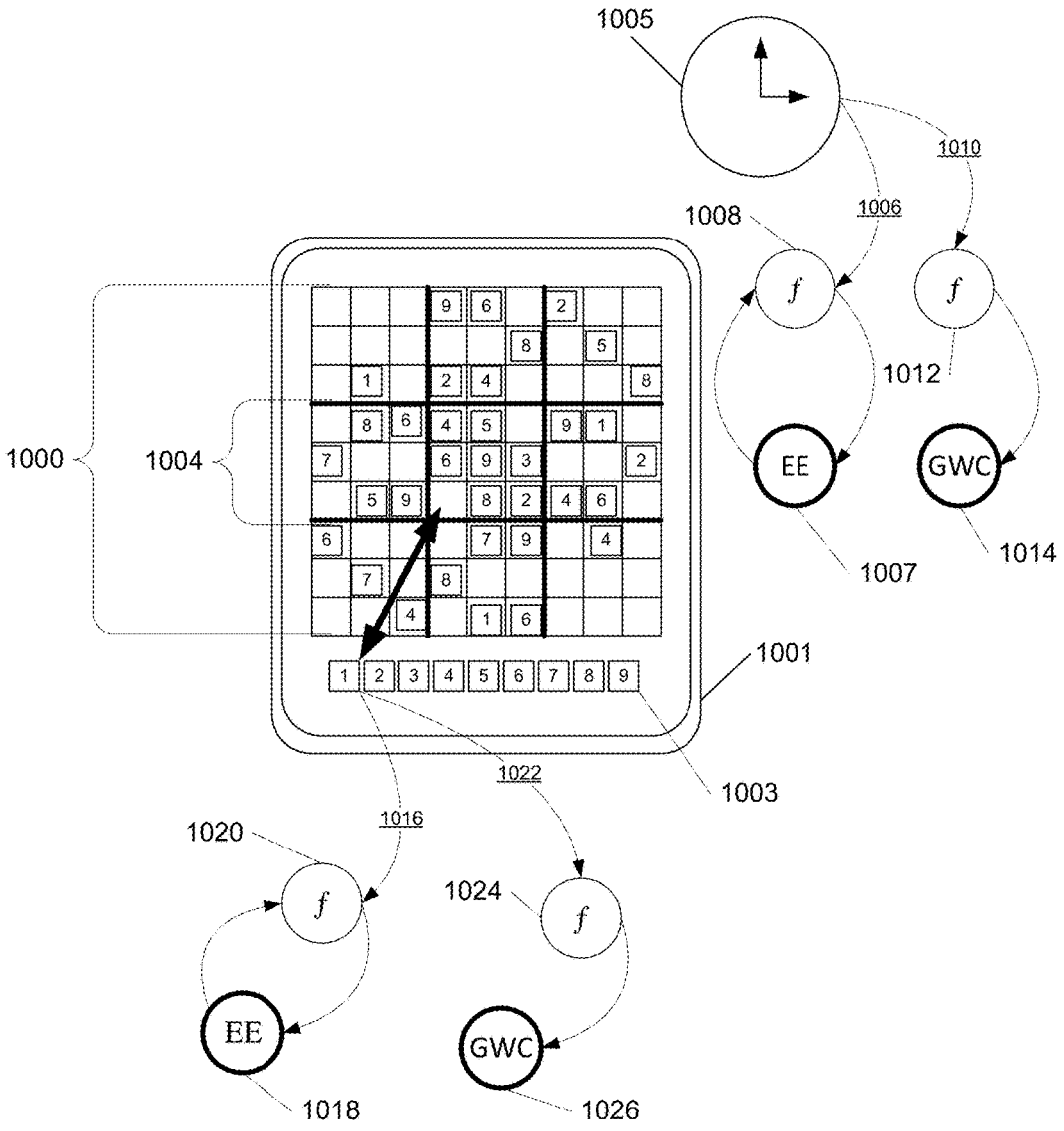
FIG. 10 is a conceptual diagram illustrating relationships between Sudoku style player actions and various elements and credits used in Sudoku style entertainment game gameplay in accordance with an embodiment of the invention.

Referring now to FIG. 10, FIG. 10 is a conceptual diagram illustrating relationships between Sudoku style player actions and various elements and credits used in Sudoku style entertainment game gameplay in accordance with an embodiment of the invention.

The puzzle game of Sudoku is a logic-based combinatorial symbol-placement puzzle. In one embodiment, the objective is to fill an array or grid 1000 of positions or boxes of a puzzle 1001 with symbols, such as digits 1003, so that each column, each row, and each sub-grid, such as sub-grid 1004 that compose the grid, contains all of a specified number of digits, numbers or symbols. In one embodiment, the grid is a square 9×9 grid of positions, each sub-grid is 3×3 positions, and the symbols are the digits from 1 to 9. To play, the puzzle is initialized with a partially completed grid, which typically has a unique solution. In many embodiments, completed puzzles typically include a constraint on the contents of individual regions of the puzzles. For example, the same single digit may not appear twice in the same playing board row or column, or in any of the sub-grids of the playing board.

In one embodiment, at the onset of game play, a player is given the choice of playing "solo" or in head-to-head mode. In solo mode the player seeks to complete the puzzle in the minimum possible time. In some embodiments, GWC is awarded as a function of the player's performance relative to a set of pre-established performance bands (e.g. completion of a game in less than 10 minutes, 10 min<x<20 min, 20 min<x<30 min, etc.). In numerous embodiments, GWC is awarded as a function of the player's performance against a historical database of completion times for players of approximately equivalent skill. In some embodiments, GWC can be further augmented or reduced as a function of game world variables such as, but not limited to: (a) the number of incorrect symbol placements made (even if corrected); (b) the number of correct symbol placements made on the first try; and (c) the number of hints received during game play.

In another embodiment, the player in solo mode does not receive GWC as a function of the speed with which they complete the game, but only as a function of the number of correct first-time symbol placements made in the grid, for example.

In various embodiments, in head-to-head mode, the player is matched up against another player (or players), who may or may not be of proximate skill, and the players solve the same puzzle. This may not be done in an exactly synchronous way (i.e. they may not have to start at the same time), though it can be. In some head-to-head embodiments, more GWC is awarded to the player who finishes the puzzle most quickly, again with the possibility of GWC awards and penalties as a function of various factors. Players may have the ability to directly engage with known persons to compete against, may choose opponents through an arbitrated process, or may be assigned opponents by the hybrid game system.

In various embodiments, to enable players of different skill levels to compete head-to-head, handicapping can be used. Handicapping can take one of a number of forms. In one embodiment, the more advanced player starts with a time penalty, i.e. whereas the less skilled player's timer starts without a time penalty. In one embodiments, the less skilled player's timer starts at 0:00:00 (hour:min:sec), the more skilled player's timer may start at 0:05:00 for a slight difference in skill, or at 0:15:00 for a greater skill disparity. This time penalty may be applied as a function of skill bands into which players fall (i.e. player A is in a low-skill band, and player B is in a high-skill band). In some embodiments, the time penalty is crafted in the context of the specific players themselves and their historical performance on puzzles of difficulty comparable to that currently being presented.

In some embodiments, handicapping alters the rate at which players accumulate GWC as a function of their in-game performance, the rate being higher for lower skilled players than higher skilled players.

In many embodiments, handicapping provides the lower skilled player with a fixed "bump" in GWC for the purposes of calculating the winner in the head-to-head competition.

In another embodiment of head-to-head competition, players compete to simultaneously complete the same puzzle. Each player gains GWC each time they correctly place a symbol in the grid or array, and is penalized for each incorrect placement. Alternately, players gain GWC for each correct placement, and correction of an incorrect placement, as well as being penalized for incorrect placements (which they cannot then correct, but only the other player(s) can correct). Any combination of these factors can also be used to drive GWC performance.

In various embodiments, in addition to choosing whether to play solo or head-to-head, a player can make choices regarding the puzzle to be solved. A player may need to undertake a gambling game to initiate the selection of a different puzzle (i.e. a different set of initial conditions) with the result of the gambling game affecting (for example) the difficulty of the puzzle presented (said difficulty being explicitly communicated to the player or implicitly—for example by virtue of the number of symbols pre-loaded into the array or grid).

In another embodiment, a gambling proposition, bet or wager, (the same as above, or a distinct one) can also affect the GWC "prize" available for a given, constant, puzzle, the nature of the rules (i.e. what sort of things are penalized and/or rewarded), whether the game has a hard stop timewise, and so on.

In many embodiments, the player can gamble repeatedly to configure the game to their liking, though the puzzle may only be shown to the player for a short while before the player has to decide whether to go-forward with that puzzle or select another (for example), to prevent gaming of the system.

Players may also make selections about the amount of money to commit to each gambling.

Game Play

Once the puzzle has been established, and the rules set, play commences as illustrated in FIG. 10.

In one embodiment, the consumption of game time in a version of the game in which a clock 1005 counts down 1006 from X game-minutes towards zero serves as the EE 1007 that drives or triggers 1008 betting or wagering in a gambling game. Successful gambling game outcomes or wins augment the amount of game time available to complete the puzzle. In another embodiment, game time is counted up, and as each relevant unit of game time is consumed as EE, bets or wagers in one or more gambling games are triggered.

In another embodiment, the consumption of game time in a version of the game in which the clock 1005 counts down 1010 from X game-minutes towards zero and serves as a mechanism 1012 that awards or triggers the award of GWC 1014. In another embodiment, game time is counted up and the count up periods are used as a method to award GWC.

In another embodiment, the number of placements 1016 of symbols, such as but not limited to, numbers and digits, in the puzzle serve as EE 1018, are consumed by the player, and initiate or trigger 1020 betting or wagering in the gambling game. In some embodiments, successful gambling game outcomes or wins ultimately augment the number of placements available, where a placement constitutes any time a player puts down a symbol in a box, correctly or incorrectly. The amount bet, wagered or gambled per placement is established as part of the game set up.

In another embodiment, the number of "moves" (i.e. placements and retractions of symbols within the puzzle) serve as EE, and are consumed by the player, initiating or triggering betting or wagering in the gambling game. Successful gambling game outcomes or wins ultimately augment the number of moves available, be they placements or retractions. An amount bet or wagered per move is established as part of the game set up.

In another embodiment, correct placements 1022 of symbols in the puzzle serve as triggers 1024 to award GWC 1026.

In numerous embodiments, completion of certain portions of the puzzle serve as actionable elements (AE) that can be used to trigger wagers in the gambling game. Examples of completed portions serving as AEs include, but are not limited to: completing a sub-grid; completing a single row; completing a single column; completing a single diagonal; completing a row of sub-grids; completing a column of sub-grids; and completing a diagonal of sub-grids.

In some embodiments, a player has access to hints or cheats. A player can "draw" a hint/cheat from a stack of virtual "hint cards". Hints can be explicit, "The top left box is filled with the digit 8" or less direct, "The top left box is filled with an odd number". In some embodiments, the hints can be pre-established and independent of the current state of the grid, or they can be dependent upon the current state of game play. The drawing of a hint card (an EE) invokes or triggers a bet or wager in the gambling game. In many embodiments, the result or outcome of that gambling game event, bet or wager can affect the quality of that hint/cheat provided, and/or a subsequent hint/cheat card and/or augment (in the case of a gambling win, for example) the number of hints/cheats available to be drawn on a go-forward basis.

In various embodiments, GWC is awarded or decremented (i.e. it can start at a maximum value for the puzzle at the onset and be reduced as a function of one or more game variables) as a function of one or more game variables, including but not limited to: time to complete the puzzle; number of correct placements; number of incorrect placements; performance against one or more of these elements relative to a competitor; and competitors or a standard. In some embodiments, GWC levels can also be affected by the extent to which the player takes advantage of hints/cheats.

In numerous embodiments, players can gain entrance to Sudoku tournaments as a function of GWC accumulated or retained across one or more plays of the Sudoku style hybrid game (in the case where GWC decrements from an optimal level over the course of game play) in the context of their skill level, casino preferences, and/or other variables. These tournaments can be skill-only or hybrid game tournaments.

In various embodiments of head-to-head competition, players can participate on a single Sudoku hybrid game (i.e. compete to place symbols in boxes on the same board, or have their own boards on the same screen) or across multiple, networked hybrid games (physically in proximity or via a network).

In other embodiments of cooperative play, players can work together as teams to solve the Sudoku puzzles. In this mode, players pool their funds and EE mechanisms are shifted to using collective enabling elements (CEE). In using CEE, players draw from a pool of enabling elements in order to make placements of symbols in the puzzle or draw hints. As each player utilizes a pooled enabling element, a wager is made on behalf of all of the players. All of the players contribute RWC for the wager and the players are awarded RWC in the event of a successful wager. In some embodiments, all players are awarded additional enabling elements to the pool of enabling elements based on the outcome of the wager. In many embodiments, the players' contribution to the RWC is based on a weighting of the players' desired contribution to the RWC committed to the wager. For example, a player may wish to commit 1 RWC credit per wager whereas a cooperating player may wish to commit 10 RWC credits per wager. In such a case, each player would receive RWC awards weighted on a basis of each players contribution to the RWC. The aforementioned embodiments may all apply in this context of using CEE. (such as, but not limited to, teams can compete against one another, there can be different scoring and CEE mechanisms).

Processing apparatuses that can be implemented in a Sudoku style hybrid game are discussed below.

Processing Apparatuses

Figure 11:
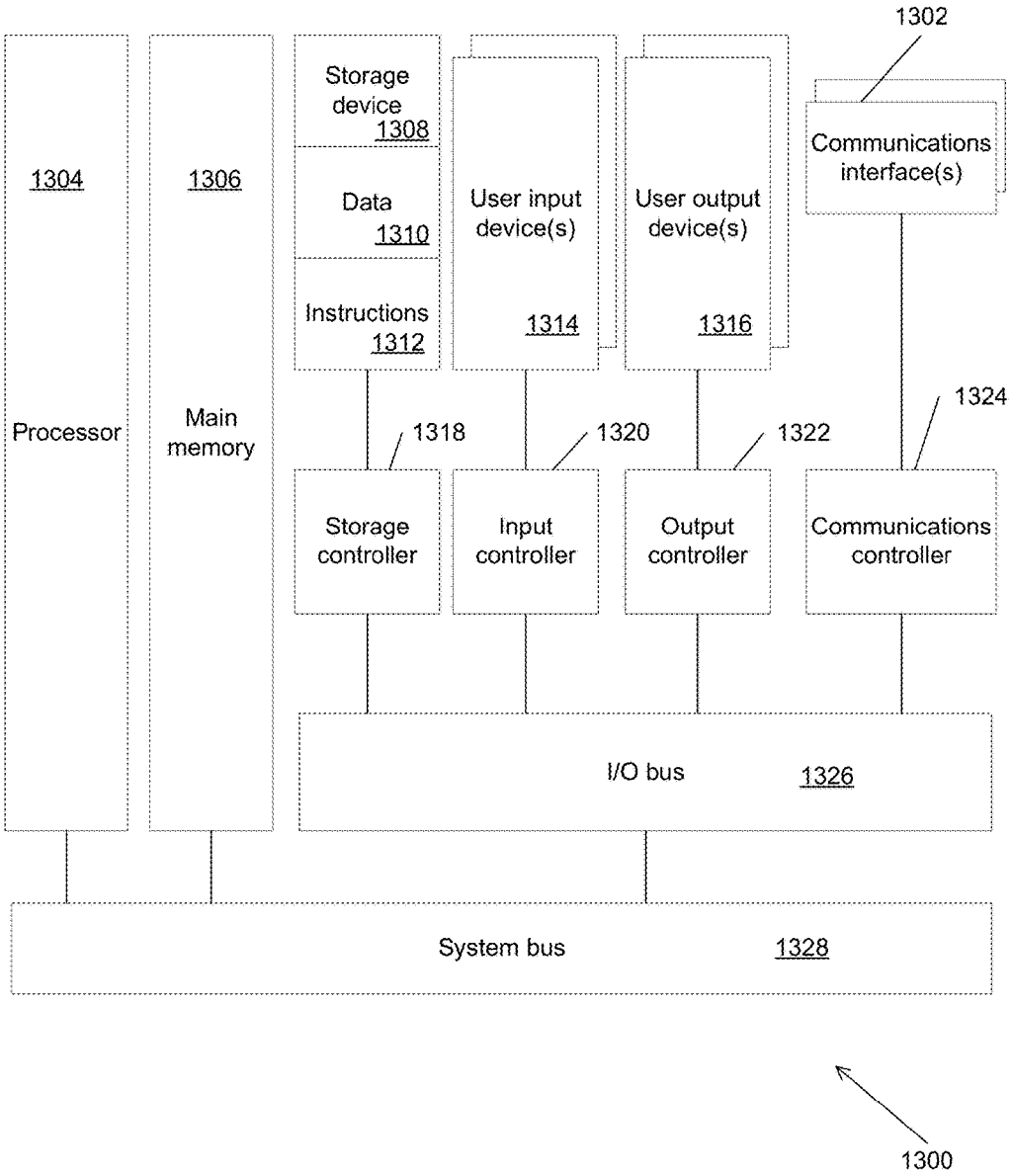
FIG. 11 illustrates a hardware architecture diagram of a processing apparatus utilized in the implementation of a Sudoku style hybrid game in accordance with an embodiment of the invention.

Any of a variety of processing apparatuses can host various components of a Sudoku style hybrid game in accordance with embodiments of the invention. In several embodiments, these processing apparatuses can include, but are not limited to, a mobile device, a gaming machine, a general purpose computer, a computing device and/or a controller. A processing apparatus that is constructed to implement all or part of a Sudoku style hybrid game in accordance with an embodiment of the invention is illustrated in FIG. 11. In the processing apparatus 1300, a processor 1304 is coupled to a memory 1306 by a bus 1328. The processor 1304 is also coupled to non-transitory processor-readable storage media, such as a storage device 1308 that stores processor-executable instructions 1312 and data 1310 through the system bus 1328 to an I/O bus 1326 through a storage controller 1318. The processor 1304 is also coupled to one or more interfaces that can be used to connect the processor to other processing apparatuses as well as networks as described herein. The processor 1304 is also coupled via the bus to user input devices 1314, such as tactile devices including but not limited to keyboards, keypads, foot pads, touch screens, and/or trackballs, as well as non-contact devices such as audio input devices, motion sensors and motion capture devices that the processing apparatus can use to receive inputs from a user when the user interacts with the processing apparatus. The processor 1304 is connected to these user input devices 1314 through the system bus 1328, to the I/O bus 1326 and through the input controller 1320. The processor 1304 is also coupled via the bus to user output devices 1316 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1328 to the I/O bus 1326 and through the output controller 1322. The processor 1304 can also be connected to a communications interface 1302 from the system bus 1328 to the I/O bus 1326 through a communications controller 1324.

In various embodiments, a processor can load instructions and data from the storage device into the memory. The processor can also execute instructions that operate on the data to implement various aspects and features of the components of a Sudoku style hybrid game as described herein. The processor can utilize various input and output devices in accordance with the instructions and the data in order to create and operate user interfaces for players or operators of a Sudoku style hybrid game (such as but not limited to a casino that hosts the Sudoku style hybrid game).

Although the processing apparatus is described herein as being constructed from a processor and instructions stored and executed by hardware components, the processing apparatus can be composed of only hardware components, or any combination thereof, in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or can be implemented on a single processing apparatus. In addition, while certain aspects and features of Sudoku style hybrid game processes described herein have been attributed to an RWE, GWE, or ESE, these aspects and features can be implemented in a distributed form where any of the features or aspects can be performed by any of a RWE, GWE, ESE within a Sudoku style hybrid game without deviating from the spirit of the invention.

While the above description may include many specific embodiments of the invention, these should not be construed as limitations on the scope of the invention, but rather as an example of one embodiment thereof. It is therefore to be understood that the present invention can be practiced otherwise than specifically described, without departing from the scope and spirit of the present invention. Thus, embodiments of the present invention should be considered in all respects as illustrative and not restrictive.

What is claimed is:

1. A network distributed hybrid game system, comprising:

a real world engine server connected by a communication link to a game world engine server, wherein the real world engine server comprises:

a real world credit meter;

a random number generator; and a real world credit pay table, wherein the real world engine server is configured to:

receive real world credit over a network from a server;

receive from the game world engine server via the communication link, a trigger of a wager of the real world credits;

determine a gambling outcome for the wager of the real world credit in response to the trigger;

communicate to the game world engine via the communication link, the gambling outcome; and allocate the randomly generated payout of real world credits to the credit meter;

a gaming cabinet including an entertainment software engine connected to the game world engine server by a network, wherein the gaming cabinet comprises:

a display screen configured to display a user interface that depicts a representation of a puzzle of a Sudoku style entertainment game; and a user input device configured to receive a player's instructions for placement of symbols within the Sudoku style entertainment game, wherein the entertainment software engine is configured to:

execute the Sudoku style entertainment game providing outcomes based upon the player's skillful execution of the Sudoku style entertainment game to earn a payout of game world credits, the skillful execution including placement of symbols into the puzzle of the Sudoku style entertainment game;

receive input for a player's action during the Sudoku style entertainment game, the player's action including the player's instructions for placement of symbols into the puzzle of the Sudoku style entertainment game;

communicate to the game world engine server via the network, the player's action taken by the player;

receive an entertainment game gameplay modification from the game world engine server;

modify entertainment game gameplay of the Sudoku style entertainment game during the player's skillful execution of the Sudoku style entertainment game based on the entertainment game gameplay modification; and generate the user interface display that depicts the representation of the puzzle of the Sudoku style entertainment game; and a game world engine server connected to the entertainment software engine of the gaming cabinet by the network and connected to the real world engine server by the communication link, wherein the game world engine server is configured to:

monitor via the network the player's actions for a gambling event occurrence where the gambling event occurrence triggers the wager of real world credits;

communicate the trigger to the real world engine server via the communication link;

receive from the real world engine server via the communication link, the gambling outcome;

generate the entertainment game gameplay modification based upon the gambling outcome during the skillful execution of the Sudoku style entertainment game; and communicate the entertainment game gameplay modification to the entertainment software engine of the gaming cabinet.

2. The network distributed hybrid game system of claim 1, wherein the gambling event occurrence is passage of a period of time during the player's skillful play of the Sudoku style entertainment game.

3. The network distributed hybrid game system of claim 1, wherein the gambling event occurrence is placement by the player of a symbol in the puzzle of the Sudoku style entertainment game.

4. The network distributed hybrid game system hybrid game of claim 1, wherein the gambling event occurrence is retraction by the player of a placement of a symbol in the puzzle of the Sudoku style entertainment game.

5. The network distributed hybrid game system of claim 1, wherein the entertainment game modification is an addition of a symbol placement enabling element, the symbol placement enabling element enabling placement by the player of a symbol in the puzzle of the Sudoku style entertainment game.

6. The network distributed hybrid game system of claim 1, wherein the entertainment game modification is an addition of a retraction enabling element, the retraction enabling element enabling retraction by the player of a symbol in the puzzle of the Sudoku style entertainment game.

7. The network distributed hybrid game system of claim 1, wherein the entertainment game modification is an addition of a period of time available for playing by the player of the Sudoku style entertainment game.

8. The network distributed hybrid gaming system of claim 1, wherein the real world engine and the game world engine are configured using a same processing apparatus.

9. The network distributed hybrid gaming system of claim 1, wherein the real world engine and the game world engine are configured using separate processing apparatuses, and wherein the communication link includes the network.

* * * * *